US007730758B1

(12) United States Patent
Smith

(10) Patent No.: US 7,730,758 B1
(45) Date of Patent: Jun. 8, 2010

(54) VEHICULAR FRAME STRAIGHTENING APPARATUS

(76) Inventor: George D. Smith, 5002 Country Club La., Sterling, IL (US) 61081

( * ) Notice: Subject to any disclaimer, the term of this patent is extended or adjusted under 35 U.S.C. 154(b) by 0 days.

(21) Appl. No.: 12/313,748

(22) Filed: Nov. 24, 2008

(51) Int. Cl.
*B21J 13/08* (2006.01)

(52) U.S. Cl. ..... 72/457; 72/447; 72/705

(58) Field of Classification Search ..... 72/295, 72/296, 298, 447, 457, 705
See application file for complete search history.

(56) References Cited

U.S. PATENT DOCUMENTS

| | | | | |
|---|---|---|---|---|
| 2,442,425 | A | 6/1948 | Merrill et al. | |
| 2,563,526 | A | 8/1951 | Gingrich et al. | |
| 2,717,020 | A | 9/1955 | Dobias | |
| 3,276,237 | A * | 10/1966 | Transue | 72/295 |
| 3,626,747 | A | 12/1971 | Rouis | |
| 3,680,353 | A | 8/1972 | Hagerty | |
| 3,776,022 | A | 12/1973 | Lionello | |
| 3,835,693 | A | 9/1974 | Majersky | |
| 4,055,061 | A | 10/1977 | Bayorgeon et al. | |
| 4,070,899 | A | 1/1978 | Venalainen | |
| 4,151,737 | A | 5/1979 | Spektor | |
| 4,262,519 | A | 4/1981 | Mason | |
| 4,289,016 | A | 9/1981 | Hare | |
| 4,330,945 | A | 5/1982 | Eck | |
| 4,404,838 | A | 9/1983 | Hare | |
| 4,433,489 | A | 2/1984 | Boyce | |
| 4,603,570 | A * | 8/1986 | Dehn | 72/305 |
| 4,660,405 | A | 4/1987 | Widegren et al. | |
| 4,761,984 | A | 8/1988 | Fuscaldo, Jr. | |
| 4,794,783 | A | 1/1989 | Eck | |
| RE32,926 | E | 5/1989 | Colby | |
| 4,827,759 | A * | 5/1989 | Mattson | 72/447 |
| 4,845,974 | A | 7/1989 | Bergstrom | |
| 4,848,136 | A | 7/1989 | Venalainen | |
| 4,905,496 | A | 3/1990 | Venalainen | |
| 4,916,933 | A | 4/1990 | Celette | |
| 4,930,333 | A * | 6/1990 | Marbury | 72/447 |
| 4,955,224 | A | 9/1990 | Field | |
| 4,958,439 | A | 9/1990 | Dehn | |
| 5,036,695 | A | 8/1991 | Bergeron | |
| 5,058,286 | A | 10/1991 | Chisum | |
| 5,186,038 | A | 2/1993 | Venalainen | |
| 5,189,899 | A | 3/1993 | Hsu | |
| 5,207,002 | A | 5/1993 | Humblet | |
| 5,253,509 | A | 10/1993 | Venalainen | |

(Continued)

*Primary Examiner*—Edward Tolan
(74) *Attorney, Agent, or Firm*—Meroni & Meroni, P.C.; Charles F. Meroni, Jr.; Christopher J. Scott

(57) ABSTRACT

An apparatus straightens vehicular structure, and comprises a U-shaped main frame, a pair of lift tower assemblies, and a pull tower assembly. The length of the main frame comprises spaced attachment structure for attaching the pull tower assembly. The lift tower assemblies are fastened to the main frame intermediate its length and function to fix the position of the vehicle relative to the main frame. The pull tower assembly is attachable to the main frame at a select attachment site and a tension member is attached to adjacent select vehicular structure. Thereafter tension may be applied to the select vehicular structure based from the attachment site to the main frame. Multiple tower assemblies may work in tandem with one another peripherally to the vehicle; a rear frame member may close the open end of the main frame; and vehicle support cross members may be included to support the framed vehicle.

20 Claims, 20 Drawing Sheets

U.S. PATENT DOCUMENTS 5,638,718 A 6/1997 Venalainen
6,094,964 A * 8/2000 Estrate ..... 72/457
6,446,481 B1 * 9/2002 Ballard et al. ..... 72/446
6,484,554 B2 * 11/2002 Soyk ..... 72/447
6,745,612 B1 * 6/2004 McIlwraith ..... 72/457
6,886,266 B2 5/2005 Kidd et al.
7,216,524 B1 * 5/2007 Brewer et al. ..... 72/457

* cited by examiner

VEHICULAR FRAME STRAIGHTENING APPARATUS

BACKGROUND OF THE INVENTION

1. Field of the Invention

The present invention generally relates to an apparatus for straightening vehicular structure, and more particularly to an apparatus and method for straightening vehicular frames.

2. Description of the Prior Art

U.S. Pat. No. 2,717,020 ('020 Patent), which issued to Dobias, discloses a Vehicle Body Straightening Apparatus. The '020 Patent describes a straightening apparatus comprising a pair of elongated runways, cross braces disposed beneath and secured to the ends of said runways and supporting the runways in elevated substantially parallel positions, a base member extending transversely beneath said runways, means slidably connecting said base member to bottom portions of the runways for supporting the base member beneath the runways for sliding movement longitudinally thereof, a pair of uprights fixed to and raising from said base member, said uprights being disposed on outer sides of the runways, a pair of fluid pressure actuated rams, means detachably connected to and rising from said base member, said uprights before adjustably supporting said rams relatively to the uprights in desired positions to engage parts of a vehicle mounted on the runways between the uprights, a second base member disposed between corresponding ends of said runways and slidably supported on the cross brace supporting said runway ends for sliding movement of said second base member transversely of the runways, means retaining said second base member against swinging movement relatively to the runways, an upright fixed to and rising from said second base member and disposed beyond said runway ends, a third fluid pressure actuated ram, and means detachably and adjustably supporting said third ram on said last mentioned upright.

U.S. Pat. No. 3,626,747 ('747 Patent), which issued to Rouis, discloses certain Attachments for Frame-Straightening Machine. The '747 Patent describes a vehicle frame straightening machine which has a flat, rigid base formed of longitudinal side rails and transverse front and rear ends, the latter framed with parallel vertical slots. The side rails are formed with inward facing horizontal slots which receive the ends of transverse vertically slotted horizontal rails, fitting between the side rails and longitudinally movable with respect thereto. The attachment is formed with a vertical longitudinal slot. It may be attached to either the front or rear end by resting same upon the end and inserting bolts through the slot in the attachment and through different slots in the end. By sliding the bolts laterally of the base the lateral position of the attachment is adjusted and by swinging the attachment in an arc, permitting the bolts to slide in the slots and then tightening nuts on the ends thereof the attachment is fixed in diagonal position. Similarly, a bolt may be inserted through the attachment slot in the transverse rails slot and also a hook through the attachment slot to engage the side rail to locate the attachment at a diagonal. Means is provided to apply diagonal pulls to a vehicle frame on the base. Improvements in an apparatus for straightening automobile frames in that the new apparatus is mobile and collapsible. The apparatus is mounted on casters and also disassembles for ease in moving and storing. It also allows for pulling the automobile frame in any direction by locating slidable and rotatable brackets on both longitudinal and transverse beams, thus allowing the pulling device to be quickly and easily mounted to enable the application of straightening force in any position around the perimeter of the automobile.

U.S. Pat. No. 3,835,693 ('693 Patent), which issued to Majersky, discloses a Collapsible Straightener for Automobile Frames. The '693 Patent describes certain improvements in an apparatus for straightening automobile frames in that the new apparatus is mobile and collapsible. The apparatus is mounted on casters and also disassembles for ease in moving and storing. It also allows for pulling the automobile frame in any direction by locating slidable and rotatable brackets on both longitudinal and transverse beams, thus allowing the pulling device to be quickly and easily mounted to enable the application of straightening force in any position around the perimeter of the automobile.

U.S. Pat. No. 4,070,899 ('899 Patent), which issued to Venalainen, discloses a Metal Deforming Apparatus for Purposes such as Automobile Repairs. The '899 Patent describes a metal deforming apparatus in which a frame of the apparatus carries a vertically movable support structure which in turn carries a gripping structure for gripping a part such as a vehicle body which is situated over the vertically movable support structure, a suitable structure being provided for vertically moving the vertically movable support structure with respect to the frame. A horizontal telescopic beam assembly is carried by the frame and is capable of having its length changed by a beam moving structure. A clamp is provided for clamping a part which is to be deformed or for clamping a tool which is to act on such a part. A positioning structure carries the clamp and is connected with the beam assembly for adjusting the position of the clamp. The structure which moves the vertically movable support with respect to the frame is capable of applying vertical pushing or pulling forces to a part which is to be deformed while the structure which changes the length of the telescopic beam assembly is capable of applying horizontal pushing or pulling forces to the part which is to be deformed.

U.S. Pat. No. 4,151,737 ('737 Patent), which issued to Spektor, discloses an Apparatus for Repairing and Straightening. The '737 Patent describes an apparatus for use in repairing and straightening the body and frame of a vehicle. The preferred apparatus includes a tread member including left and right track members for supporting a vehicle thereon, a tram member movable along and between the right and left track members and including two elongatable pull towers pivotally mounted thereto, and an additional elongatable pull tower mounted adjacent an end of the apparatus. A flexible connector, preferably a chain, is arranged for connection between the pull towers and the vehicle. The track members further include regularly shaped apertures which vertically pass therethrough. Locking pins are also provided which extend through an aperture of the track members and abut with a portion of the pull towers to lock the pull towers at any desired angle to the tread member. Bolsters are further provided which extend through the regular apertures of the track member and abut with a portion of the vehicle frame for anchoring the vehicle to the apparatus to prevent the vehicle from moving when it is subjected to the counter forces during the repair and straightening operation.

U.S. Pat. No. 4,330,945 ('945 Patent), which issued to Eck, discloses a Vehicle Frame and Body Alignment Apparatus. The '945 Patent describes an alignment checking and measuring apparatus for vehicle frame and body portions includes two or more measurement scale carriers which have connectors on opposite end portions thereof for attachment transversely to the vehicle. One of the measurement scale carriers has targets movably mounted on the end portions and another of the measurement scale carriers has sighting instruments, such as laser beam emitting instruments, mounted on the end portions. The measurement scale carriers are longitudinally spaced from each other. Longitudinally aligning the sighting instruments with the targets facilitates determination and correction of any damaged or misalignment condition in the vehicle frame and body. Comparison is made of the deviation, if any, in the parallelism of the lines of sight created by the longitudinally aligned targets and sighting instruments. Angular deviation of the lines of sight to symmetrical points on the vehicle frame and body tends to indicate damage or misaligned conditions.

U.S. Pat. No. 4,794,783 ('783 Patent), which issued to Eck, discloses a Vehicle Repair and Alignment Rack. The '783 Patent describes a vehicle repair and alignment rack for correcting and aligning misshapened vehicle frame and body portions comprises a rack structure having a vehicle supportive upper surface and a lower surface with opposite side rack portions having inner and outer flanges joined together to form a central opening, whereby a vehicle straddles the opening for work access to the vehicle underside. Front and rear supportive legs are affixed to the rack structure for elevation above a floor surface and have power fluid rams operatively connected thereto for folding the legs and lowering the rack structure to the floor to facilitate positioning a vehicle on the rack. Force supplying members are affixed to the rack structure and are easily movable therearound so that they can be selectively positioned to exert pulls on substantially any part of the vehicle. A front end of the rack structure is removable and replaceable so that the repairman has easy access to the lower front side of the vehicle, a common location for vehicle damage.

U.S. Pat. No. 4,905,496 ('496 Patent), which issued to Venalainen, discloses a Procedure in Car Body Rectifying Work and Rectifying Means Arrangement. The '496 Patent describes a procedure in car body rectifying work. In the procedure the vehicle is driven onto the rectifying table of the car body rectifying unit and affixed to skirt attachments provided on the rectifying table. The vehicle is raised, while it is on the rectifying table, with the lifting unit of the vehicle rectifying unit to desired height for the rectifying work. Hereafter the lifting unit is removed from under the vehicle and out of functional connection with the rectifying table and the vehicle is left resting on supporting legs connected with the rectifying table. The invention also relates to apparatus conforming to the procedure.

U.S. Pat. No. 4,955,224 ('224 Patent), which issued to Field, discloses an Adjustable Height Vehicle Frame Straightening Apparatus. The '224 Patent describes a vehicle repair and straightening apparatus, including a lower framework forming a cage for receiving a damaged vehicle. Structure is provided for restraining the damaged vehicle within the lower framework and a tower structure is movably attached to the lower framework for applying a force on a portion of the damaged vehicle. An upper framework is movably attached to the lower framework and structure is provided for permitting the upper framework to be selectively movable with respect to the lower framework between a lowered transport position and a raised working position. A tower structure attached to the apparatus has hydraulics associated therewith for pulling damage from a damaged vehicle but this structure is also useful to selectively move the upper framework between the transport position and the raised position thereof.

U.S. Pat. No. 5,189,899 ('899 Patent), which issued to Hsu, discloses an Apparatus for Vehicle Straightening and Repair. The '899 Patent describes a vehicle repair and alignment apparatus for correcting and aligning misshapened vehicle frames and outer body panels comprises a frame having a pair of elongate track members with slotted rails provided along the outer edges thereof, vertical pull towers pivotably mounted on a respective semicircular platen slidingly engaged on each rail enabling selective angular orientation of the pull towers with respect to the track members, and two pairs of vertical bolster cylinders powerably positionable in both horizontal directions within the track members each having clamp elements provided on the upper ends thereof for anchoring the vehicle to the apparatus. Horizontal displacements of the bolster cylinder pairs are effected remotely by actuating electric motors while vertical motion of the clamp elements are accomplished by fluid lifters. Proximity sensors on each clamp element automatically signal the limits of vertical motion when a body portion on the underside of the vehicle is within grasp.

It will be seen from a review of the foregoing that the prior art is silent on a vehicular frame straightening apparatus whereby a main frame receives a vehicular body, and one or more repositionable pull tower assemblies are removably attachable to the main frame peripheral to the vehicular body for applying tension to select vehicular structure adjacent the selectively positioned pull tower assembly. Accordingly, the prior art perceives a need for such and apparatus and associated vehicular structure straightening methodology.

SUMMARY OF THE INVENTION

The present invention thus attempts to structurally address the foregoing concerns and thus provides an apparatus for straightening vehicular structure, such as vehicular framing and the like. The apparatus according to the present invention generally comprises a U-shaped main frame, a pair of laterally opposed lift tower assemblies, and one or more portable or repositionable pull tower assemblies.

The main frame has a vehicle-receiving open end, a vehicle-stopping closed end, laterally-opposed vehicular guide portions, a longitudinal or long axis, a lateral or short axis, and an I-shaped transverse cross-section. The I-shaped transverse cross-section provides upper and lower flanges. The upper and lower flanges comprise paired, axially-aligned pin-receiving apertures at regularly spaced intervals along substantially the entire length of the main frame.

The lift tower assemblies are fastened to the main frame intermediate the open end and closed end, substantially equidistant from each end. Each lift tower assembly comprises an outer tower sheath, an inner lift member, and longitudinally opposed lift arms pivotally attached to the lift member. A vehicle is thus receivable by the main frame and supportable by the lift tower assemblies. Together, the main frame and lift tower assemblies function to fix the position of the vehicle.

The pull tower assembly(ies) essentially comprise means for applying tension to a vehicle and means for attaching the pull tower assemblies to the main frame at select locations as determined by the axially-aligned pin-receiving apertures and the target pull site on the vehicle, otherwise immobilized by the main frame and lift tower assemblies. The means for applying tension are thus cooperable with the select vehicular structure for displacing the select vehicular structure relative to the fixed vehicle position via applied tension. The apparatus according to the present invention may thus function to straighten vehicular structure such as a vehicular frame.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings:

FIG. 4(*b*) is a top perspective view of the vehicular frame straightening apparatus according to the present invention with a received vehicle, and showing a main frame, laterally opposed lift tower assemblies, and three portable pull tower assemblies selectively and peripherally arranged to the positioned vehicle.

FIG. 7(*a*) is a reduced top plan view of the main frame of the vehicular frame straightening apparatus.

FIG. 7(*b*) is a reduced second top perspective view of the main frame of the vehicular frame straightening apparatus.

FIG. 7(*c*) is a front end view of the main frame of the vehicular frame straightening apparatus.

FIG. 7(*d*) is a lateral view of the main frame of the vehicular frame straightening apparatus.

FIG. 12(*b*) is a top perspective view of the otherwise depicted in FIG. 12(*a*) showing a magnet attached to the eyebolt.

FIG. 12(*c*) is a top perspective view of a third portable pull tower assembly showing an apertured base section, an apertured upright section, a brace section extending intermediate the base and upright sections, a chain outfitted with a hook at the end thereof, an upper pulley, and an abbreviated adjustable lift arm.

DETAILED DESCRIPTION OF THE PREFERRED EMBODIMENT

Figure 1:
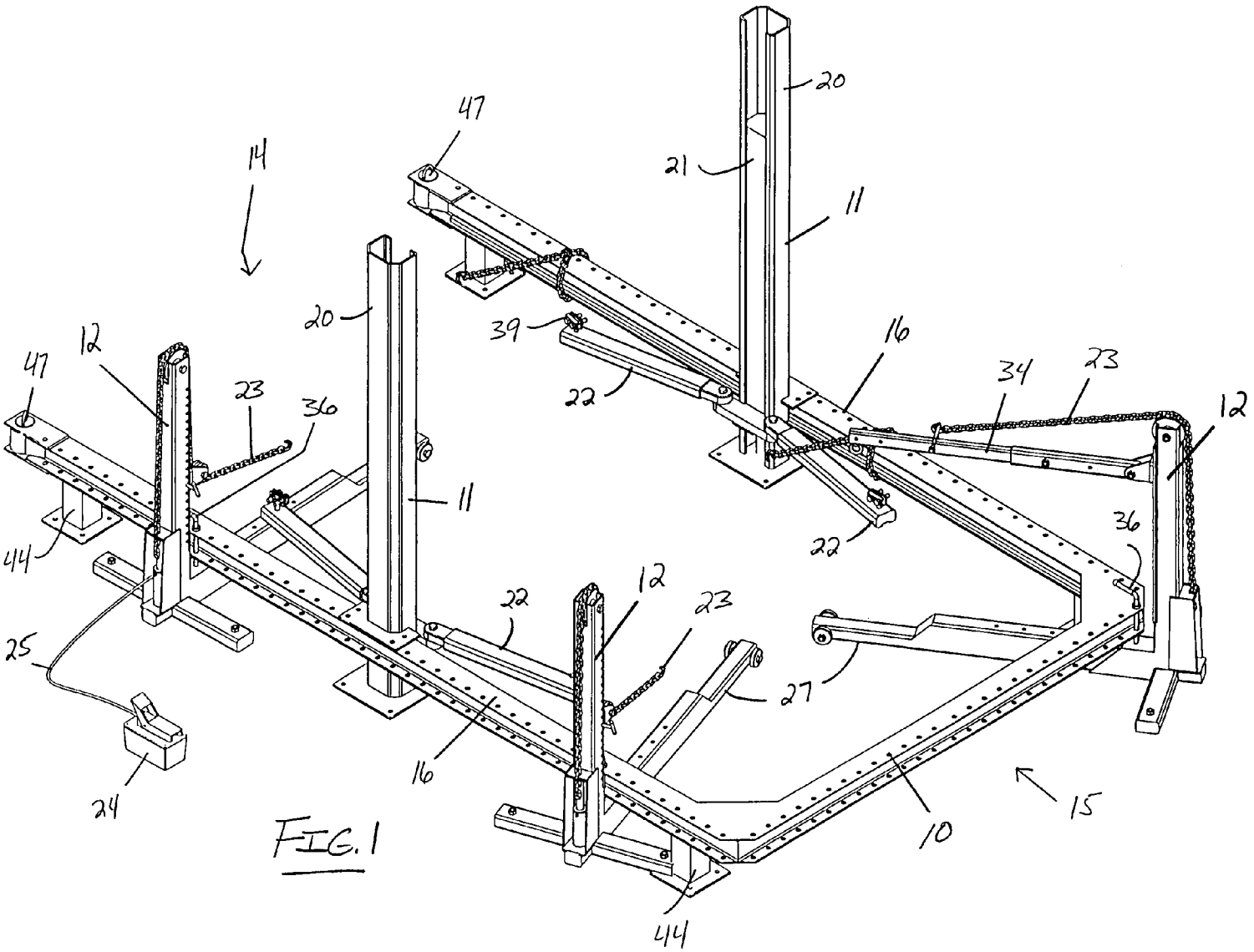
FIG. 1 is a top perspective view of the vehicular frame straightening apparatus according to the present invention showing a main frame, laterally opposed lift tower assemblies fixedly attached to the main frame, and three portable pull tower assemblies removably and selectively attached to the main frame.
Figure 2:
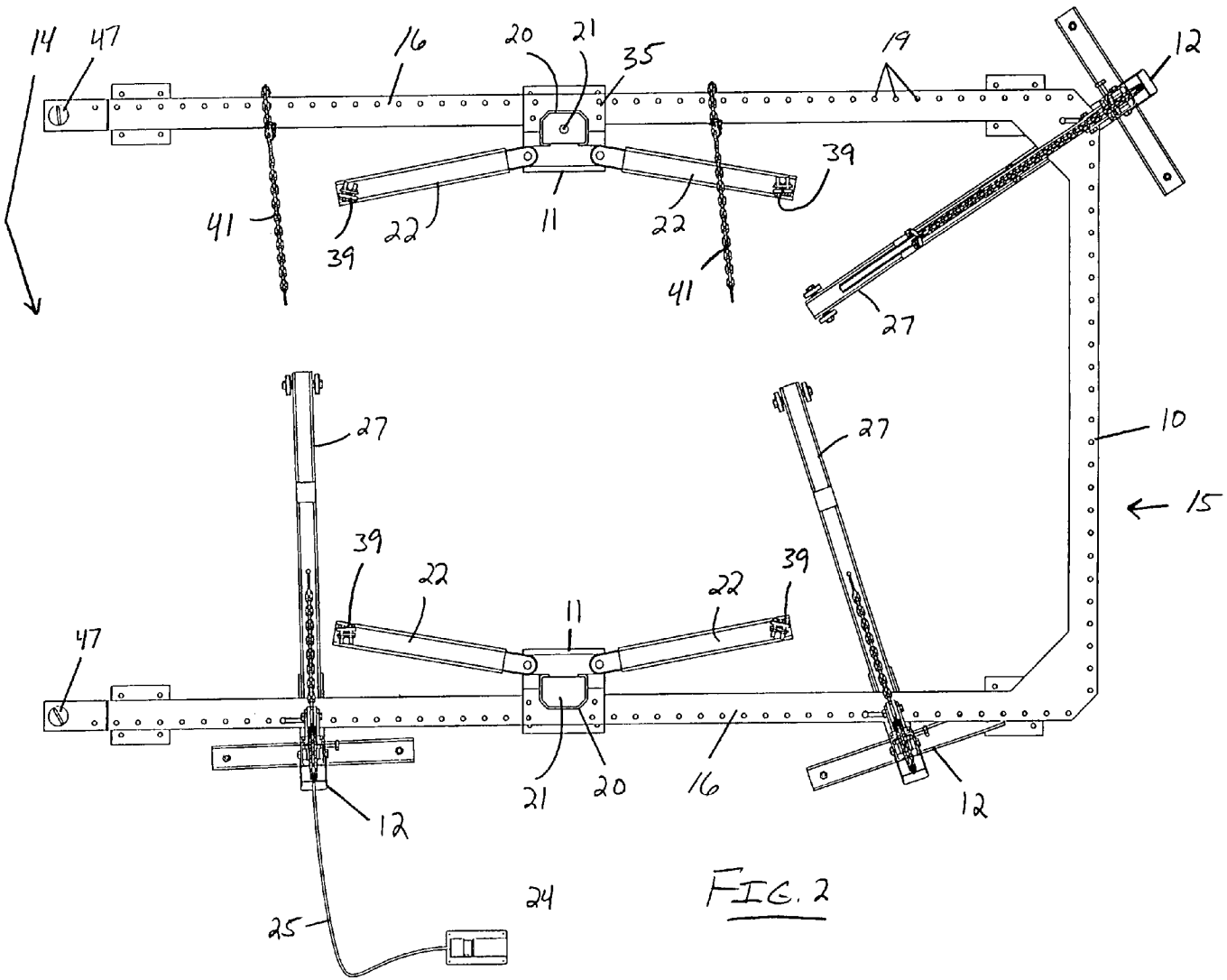
FIG. 2 is a top plan view of the vehicular frame straightening apparatus otherwise depicted in FIG. 1.
Figure 3:
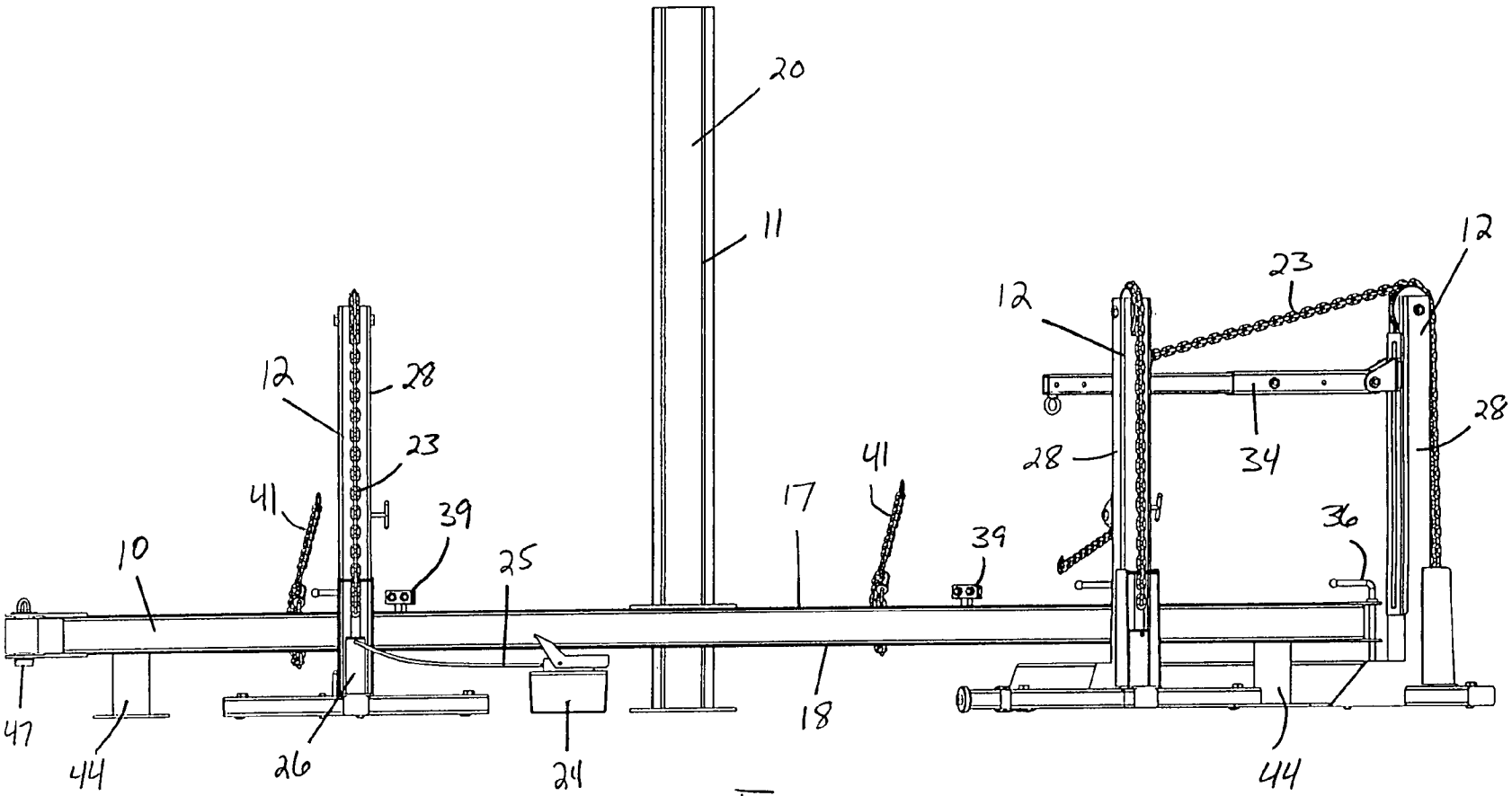
FIG. 3 is a lateral plan view of the vehicular frame straightening apparatus otherwise depicted in FIG. 1.

Referring now to the drawings with more specificity, the preferred embodiment of the present invention concerns a relatively lightweight (roughly 1,200 pounds), low cost apparatus for straightening vehicular structure, such as a vehicular frame or other associated structures attachable to such a vehicular frame. A generic vehicle 13 is generally illustrated and referenced in FIGS. 4(*a*)-6. The apparatus according to the present invention preferably comprises a U-shaped main frame 10, a pair of laterally opposed lift tower assemblies 11, and at least one portable pull tower assembly 12.

Figure 14:
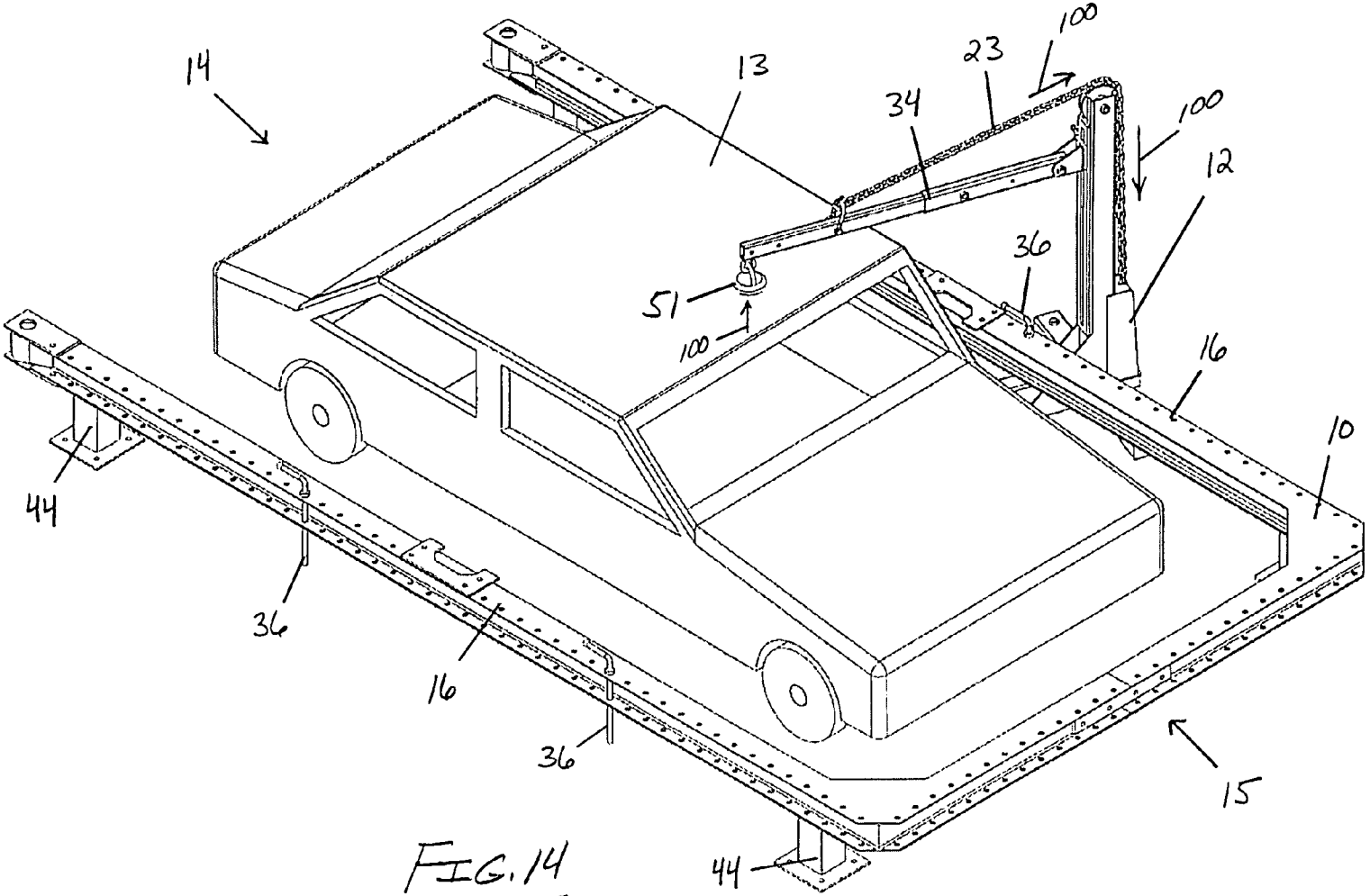
FIG. 14 is a top perspective view of the vehicular frame straightening apparatus according to the present invention with a received vehicle, and showing a main frame and a single portable pull tower assembly positioned for applying vertically directed tension to the vehicle.

Notably, the lift tower assemblies 11 are optional. From a comparative inspection of FIGS. 4(*a*)-6 versus FIG. 14, it may be seen that the lift tower assemblies 11 may be omitted, and that the pull tower assembly 12 may be operably connected to the main frame 10 for applying tension to select vehicular structure. FIG. 14 generally depicts a single portable pull tower assembly 12 positioned for applying vertically directed tension to the vehicle 13.

Figure 15:
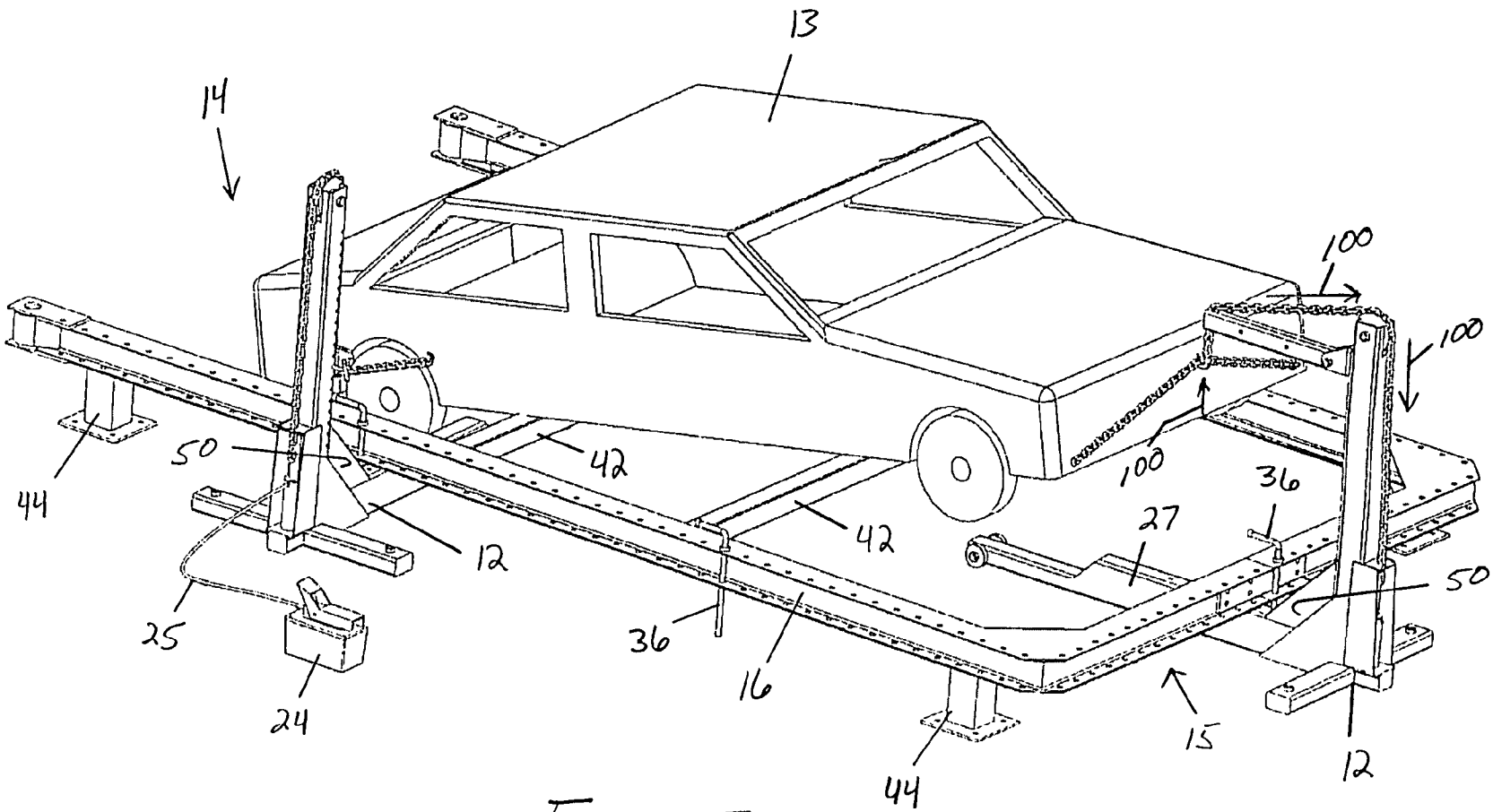
FIG. 15 is a top perspective view of the vehicular frame straightening apparatus according to the present invention with a received vehicle, and showing a main frame and first and second portable pull tower assemblies, the first for applying tension to the vehicle, and the second for lifting the front end of the vehicle.

FIG. 15 is a further depiction of the vehicular frame straightening apparatus according to the present invention with a received vehicle 13, and showing the main frame 10 and first and second portable pull tower assemblies 12, the first portable pull tower assembly 12 for applying tension to select vehicular structure, and the second for lifting the front end of the vehicle 13. In this regard, it should be noted that the pull tower assemblies 12 may be utilized to lift the vehicle 13 as may be required when the lift tower assemblies 11 are omitted.

The main frame 10 is essentially a three-sided structure preferably formed from a 6-inch by 6-inch wide flange I-beam. Thus, the main frame essentially comprises a vehicle-receiving open end as at 14, a vehicle-stopping closed end as at 15, laterally-opposed vehicular guide portions as at 16, a longitudinal or long axis, a lateral or short axis, and an I-shaped transverse cross-section. The I-shaped transverse cross-section provides an upper flange 17 and a lower flange 18. The upper and lower flanges 17 and 18 each preferably comprise paired, axially-aligned pin-receiving apertures 19 at (regularly) spaced intervals along substantially the entire length of the main frame 10.

It is contemplated that each optional lift tower assembly 11 may be defined by state of the art lift tower assemblies or two-post lifts. Each of the lift tower assemblies 11 may be fastened to the vehicular guide portions 16 of the main frame 10 via lift tower support bracket 35 intermediate the open end 14 and the closed end 15 and essentially function to lift and/or fix the position of a received vehicle 13. It may be seen from an inspection of the figures that the lift tower assemblies 11 are situated substantially equidistantly from the open end 14 and the closed end 15.

Each lift tower assembly 11 essentially comprises an outer tower sheath as at 20, an inner lift member as at 21, and longitudinally-opposed, vehicle-engaging lift arms 22 pivotally attached to the lift member 21. Each lift arm 22 may be preferably outfitted with a rocker panel clamp 39 or lift pads (not specifically illustrated), and may comprise telescopic structure so that the lift arm 22 may extend up to about 5 feet. It is contemplated that the rocker panel clamps 39 may well function to enhance attachment of the lift arms 22 to rocker panels of the vehicle 13 so as to improve the fixed position of the vehicle 13 during operation of the apparatus.

Each portable or repositionable pull tower assembly 12 essentially comprises certain means for applying tension to a vehicle and certain means for attaching the tower assembly to the main frame 10 at a select location, which select location is selected based structurally upon the pairs of axially-aligned, pin-receiving apertures 19. Each tower assembly 12 may further comprise an apertured (horizontal) base section 27 (on the order of 7 feet in length), a (vertical) upright section 28 (on the order of 5 feet in length), an upper pulley 29, a lower pulley 30, and certain means for adjusting the effective tension member (chain) height.

The means for adjusting the effective tension member height may be preferably defined by an adjustable bracket as at 31 and associated structure. In this last regard, it is contemplated that a tee handle or pin 32 may be removably insertable through axially aligned tower apertures 33 formed in the upright section 28 in order to adjust and hold the adjustable bracket 31 at a selected height upon the upright section 28.

The adjustable bracket 31 may function to (1) rotatably retain the lower pulley 30 to the upright section 28 or may function or (2) pivotally retain a lift bar 34 to the upright section 28. It is contemplated that the lift bar 34 may exemplify certain means for effecting vertically directed tension to select vehicular structure, which vertically directed tension may well function to vertically displace and straighten select vehicular structure relative to the fixed vehicular position as generally depicted in FIG. 14, or alternatively as a means to lift the vehicle 13 as generally depicted in FIG. 15.

The means for attaching the pull tower assembly 12 to the main frame 10 are preferably defined by a lock down pin or bolt 36, which bolt or pin 36 is removably received in the apertures 19 and apertured base section 27 at select apertures fixing the tower assembly 12 to the main frame 10 at a select structural location. The apertures 19 allow the user to reposition the tower assembly 12 relative to the main frame 10, and the apertures 37 of the apertured base section 27 allows the user to readjust the base and vertical sections 27 and 28 relative to the main frame 10 at the select location as defined by the holes 19 and pin 36. It is contemplated that the apertured base section 27 and the vertical adjustment means or bracket 31 and pin 32 enable the user or operator to fine tune tension direction through the tension member, as generically represented by a chain 23 in the various figures.

The means for applying tension to a vehicle may be preferably defined by a tension member or structure 23 such as a chain (member 23 may be exemplified by a ⅜ inch chain with 23,000 pound force capacity) outfitted with a hook 40 at a first end of member 23) and the means for tensioning said member (connected to a second end of member 23) may be defined by a hydraulic or a mechanical ratchet type, chain-binding mechanism 38. Other state of the art devices (such as a magnet 51) may be attached to the assemblies 12 as further depicted and referenced. Pull forces are generally referenced at vectors 100 and rotational movement is generally referenced at arrows 101.

Figure 12A:
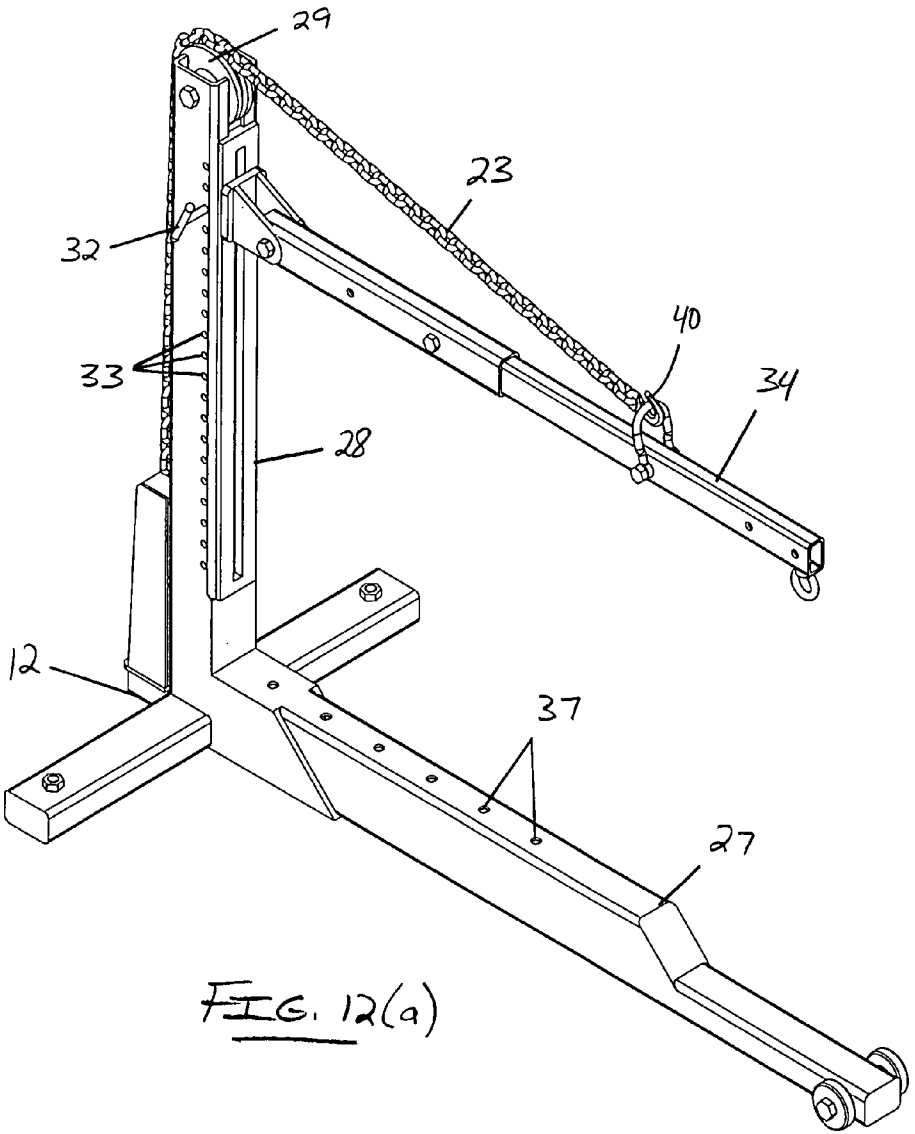
FIG. 12(*a*) is a top perspective view of a second portable pull tower assembly showing an apertured base section, an apertured upright section, a chain, a fixed upper pulley, and an extended adjustable lift arm outfitted with an eyebolt at the end thereof.
Figure 12B:
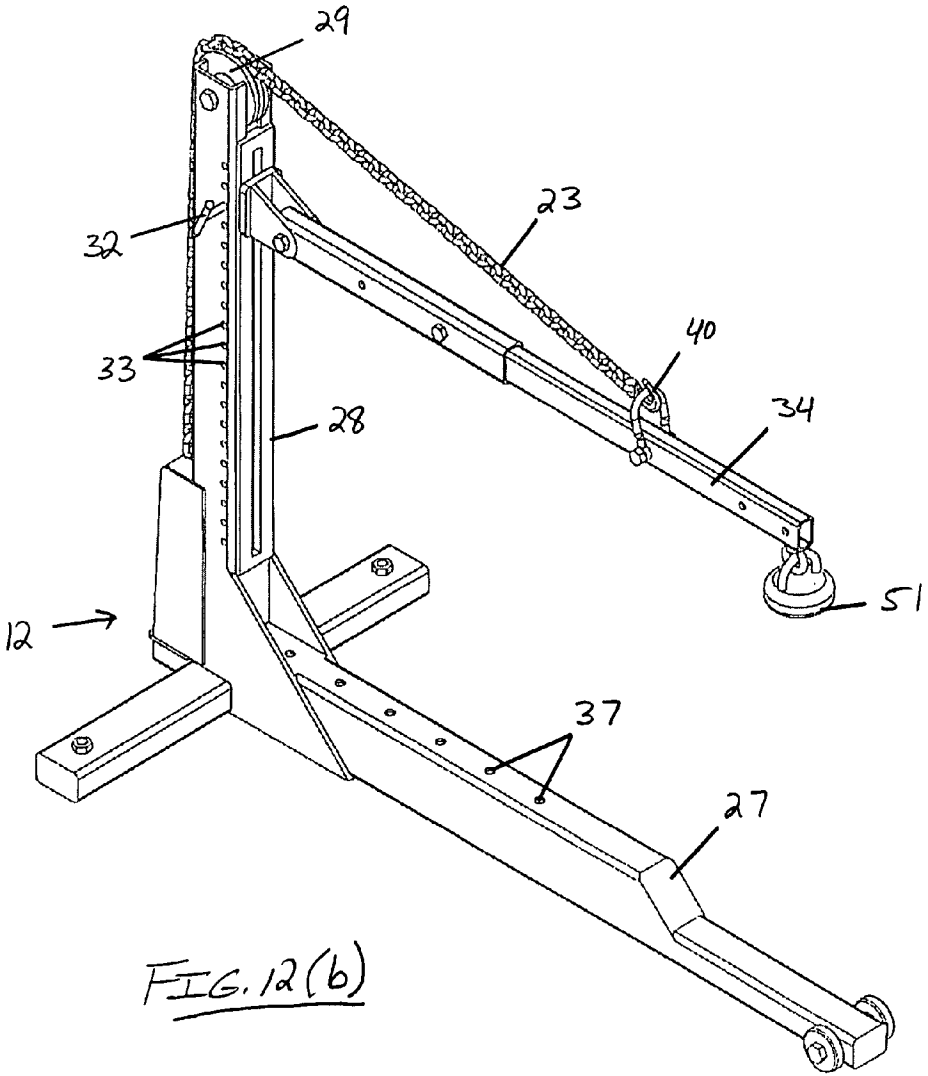
Figure 12C:
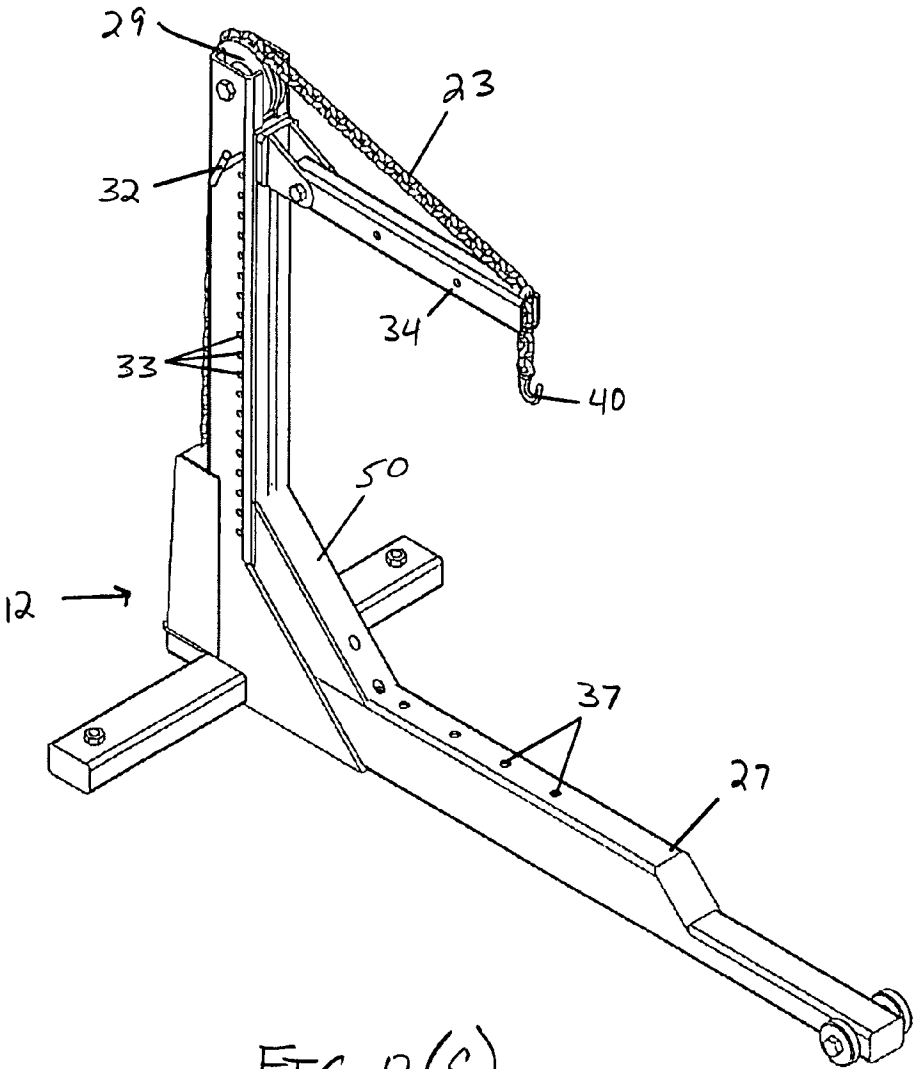
Figure 13:
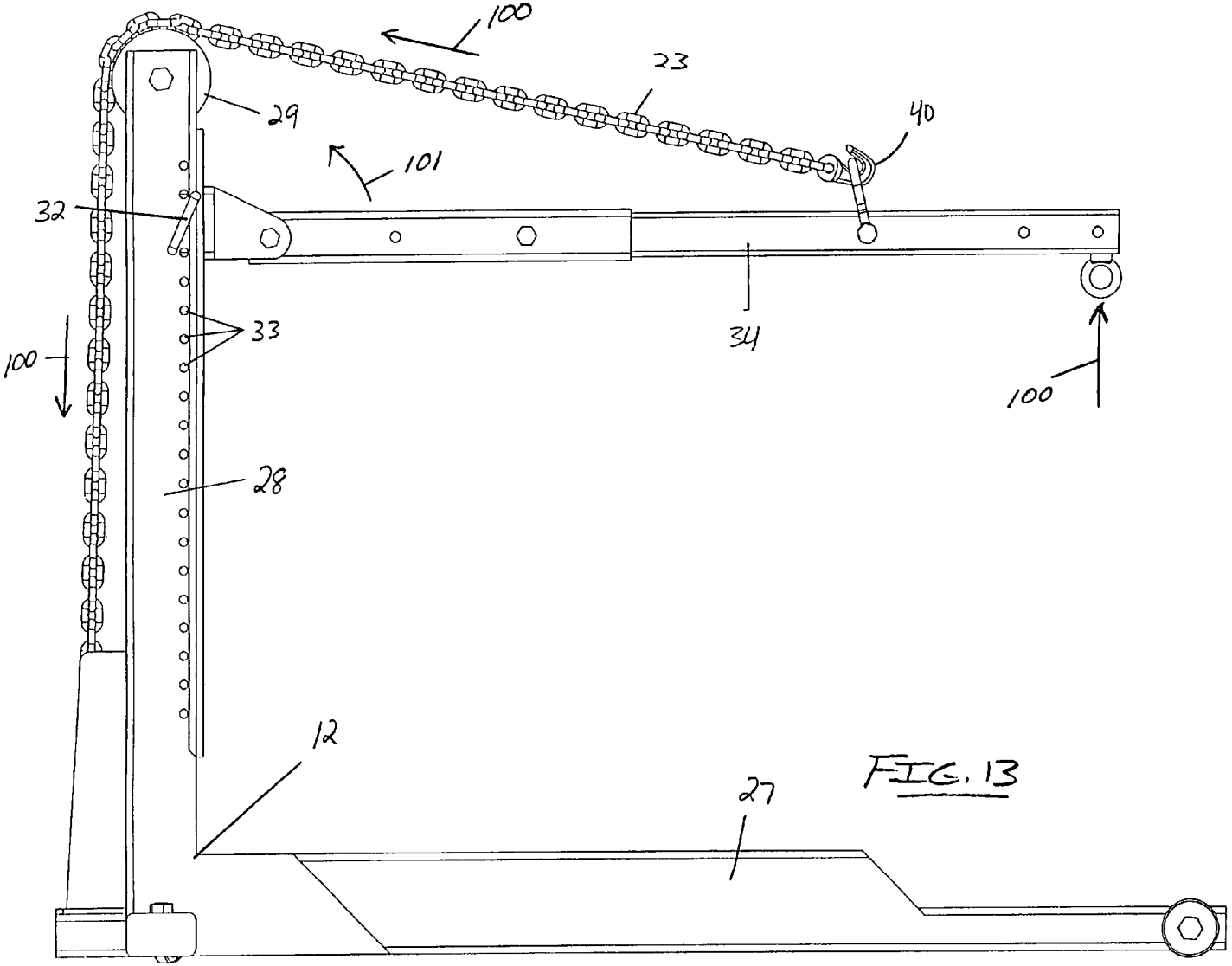
FIG. 13 is a side plan view of the portable pull tower assembly otherwise depicted in FIG. 12(*a*).

A generic, foot-operable hydraulic mechanism is generally illustrated having a foot pump or pedal assembly 24, a hydraulic hose 25 and a chain-binding cylinder assembly 26. It is contemplated that the assembly 26 may be preferably defined by a 10-ton pull ram. Given the preferred strength of the assembly 26, it is contemplated that each lift tower assembly 12 may be preferably outfitted with a rigid brace section 50 intermediate the base section 27 and upright or vertical section 28 as generally illustrated and referenced in FIGS. 12(*c*) and 15. Brace section 50 functions to maintain the integrity of the assembly 12 during operation.

The main frame 10 and tower assemblies 11 effectively function to fix the position of a received vehicle 13. Tie down chains 41 may aid the vehicle fixing function, which chains 41 or similar other tension members may attach directly to the guide portions 16 as generally depicted. The tension members attach to select vehicular structure(s) as per state of the art techniques well understood by those of ordinary skill in the art.

Essentially, the means for applying tension apply tension to a select vehicular structure and thereby displace the select vehicular structure relative to the fixed vehicle position via applied tension or force. Through select vehicular structure displacement, the apparatus functions to straighten vehicular structure such as a vehicular frame.

Figure 16:
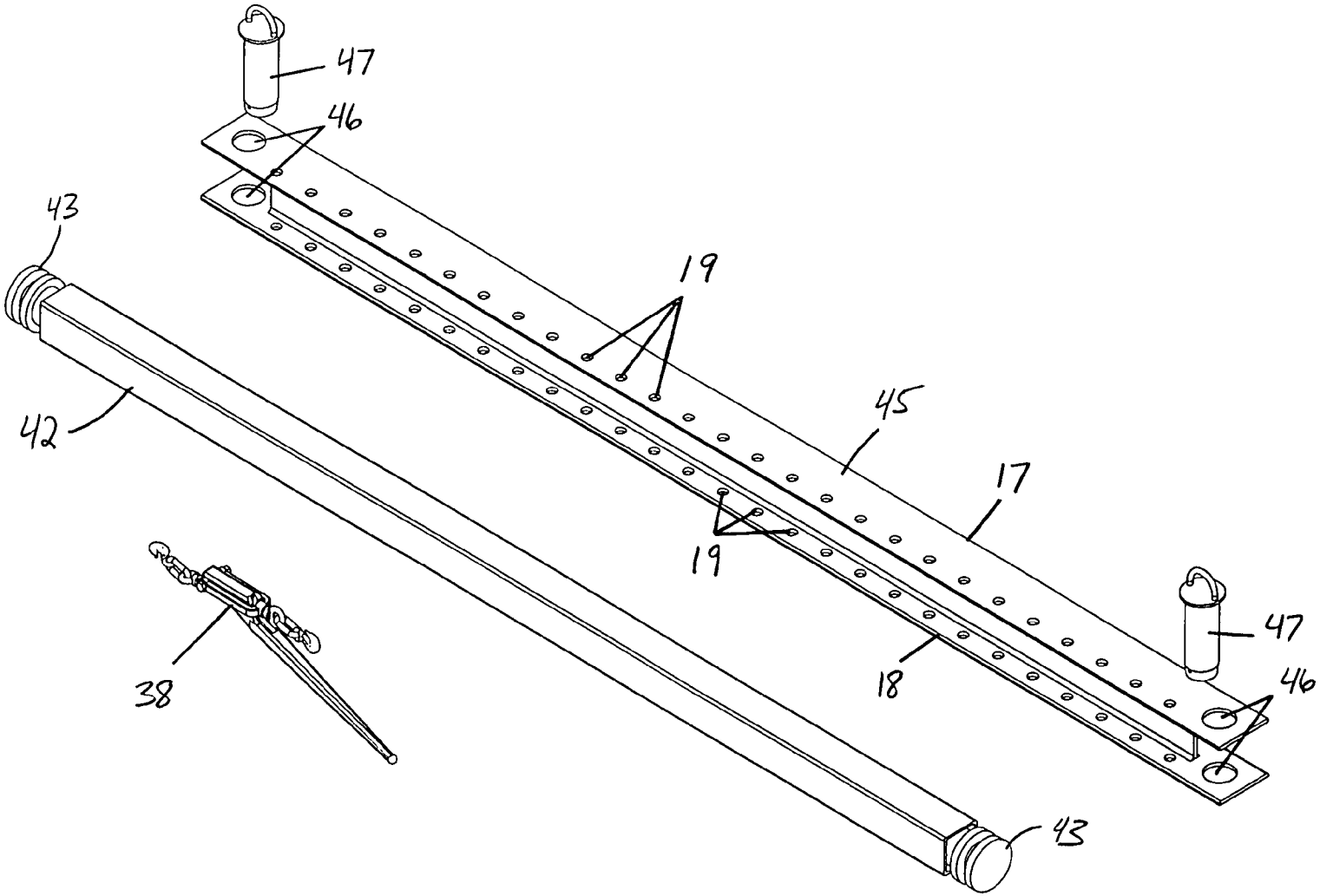
FIG. 16 is a perspective view of several optional components including a chain binder, a vehicular support cross beam with end-located roller members, and a rear frame member with upper and lower apertured flanges.

The apparatus may further comprise one or more vehicle support cross members 42 as generally depicted in FIGS. 15 and 16. It is contemplated that each cross member 42 may be preferably formed from a 4-inch by 4-inch tube. Inside the 4×4-inch tube a 3.5 inch round tube outfitted with rollers 43 on the first and second ends thereof.

The first and second cross member ends are receivable intermediate the upper and lower flanges 17 and 18 of the guide portions 16 of the main frame 10. It is contemplated that the vehicle support cross member(s) 42, and the vehicular guide portions 16 of the main frame 10 and main frame support posts 44 may together cooperably function to support a vehicle 13.

The apparatus according to the present invention may further comprise a rear frame member 45 or open end closing structure as generally depicted in FIG. 16. Preferably, the frame member 45 comprises a similar transverse cross-section and is of equivalent material construction as the main frame 10. The rear frame member 45 essentially comprises first and second ends and an I-shaped transverse cross-section (6-inch by 6-inch wide flange I-beam construction) providing upper and lower flanges akin to flanges 17 and 18.

The upper and lower flanges (17 and 18) of the rear frame member 45 further comprise paired, axially-aligned pin-receiving apertures 19 at spaced intervals along the length of the rear frame member 45. Further, the first and second ends of the rear frame member 45 comprise relatively larger pin-receiving apertures as at 46 for receiving relatively robust (as compared to pins 32 or 36) rear-to-main frame fastening pins 47 (preferably about 2-3 inch diameter pins).

Accordingly, the vehicular guide portions 16 of the main frame 10 at the open end 14 each preferably comprises apertures (46) of a similar size for axial alignment with the end apertures (46) of the rear frame member 45 such that the rear frame member 45 is attachable to the main frame 10 at the open end 14 to otherwise close the open end 14. In other words, the rear frame member 45 is preferably attachable to the main frame 10 via locking pins 47 removably insertable into axially aligned pin-receiving apertures 46 formed in the rear frame member 45 and the main frame 10.

While the foregoing specifications and drawings are set forth in some detail, the specific embodiments described and illustrated thereby are to be considered as exemplifications of the principles of the invention and are not intended to limit the invention(s) to the specific embodiments illustrated. For example, it is contemplated that the present invention essentially discloses an apparatus for straightening a vehicular frame, the apparatus comprising: a U-shaped main frame, certain vehicle position-fixing means, and a repositionable tower assembly.

The main frame 10 essentially comprises a vehicle-receiving open end 14, a vehicle-stopping closed end 15, and laterally opposed vehicular guide portions as at 16. The closed end and guide portions define a frame length, which frame length comprises main frame spaced structure (such as apertures 19) for removably attaching certain repositionable tension applicator means. The vehicle position-fixing means essentially function to fix a vehicular position, as bound by and relative to, the main frame 10. The vehicle position-fixing means, as may be exemplified by the lift towers 11 (or pull assemblies 12) are attached to the main frame 10 and interface the vehicle 13 to the main frame 10.

Each re-positionable tower assembly (as may be exemplified by assembly(ies) 12) comprises (1) certain horizontal tension applicator means for applying primarily horizontally directed tension to the vehicle or select structure thereof, and (2) certain tower attaching means (as may be exemplified by pins 36) for attaching the tower assembly to the main frame at a select frame location. The select frame location may be selected based upon the main frame spaced structure as may be exemplified by the apertures 19.

Together, the main frame and vehicular position-fixing means effectively function to fix the position of the vehicle. The tension applicator means function to apply tension to a select vehicular structure, which applied tension functions to displace the select vehicular structure relative to the fixed vehicle position. The apparatus according to the present invention may thus function to straighten a vehicular structure such as a vehicular frame or other associated structure attached to the frame.

The apparatus may comprise one or more vehicle support cross member(s) and/or the rear frame member comprising first and second ends and rear frame spaced structure intermediate the first and second rear frame ends, the rear frame member being attachable to the main frame at the open end to otherwise close the open end, the select frame location being selected based upon the main frame spaced structure and the rear frame spaced structure.

Stated another way, the apparatus according to the present invention is one for straightening vehicular structure, and comprises a main frame assembly and repositionable tension applying means. The main frame assembly may be said to comprise a main frame and vehicle position-fixing means attached to the main frame.

The main frame has a vehicle-receiving open end, and vehicular guide portions. The guide portions define a frame length having regularly spaced structure (as exemplified by apertures 19) for removably attaching the repositionable tension applying means thereto. The vehicle position-fixing means essentially function to fix (the position of) a vehicle relative to the main frame.

The repositionable tension applying means function to apply tension to the vehicle and are attachable to the main frame at select spaced structure. The main frame and vehicle position-fixing means function to fix the position of the vehicle. The tension applying means function to apply tension to a select vehicular structure. Applied tension functions to displace the select vehicular structure relative to the fixed vehicle position, and the apparatus according to the present invention may well function to straighten vehicular structure such as a vehicular frame.

Figure 4A:
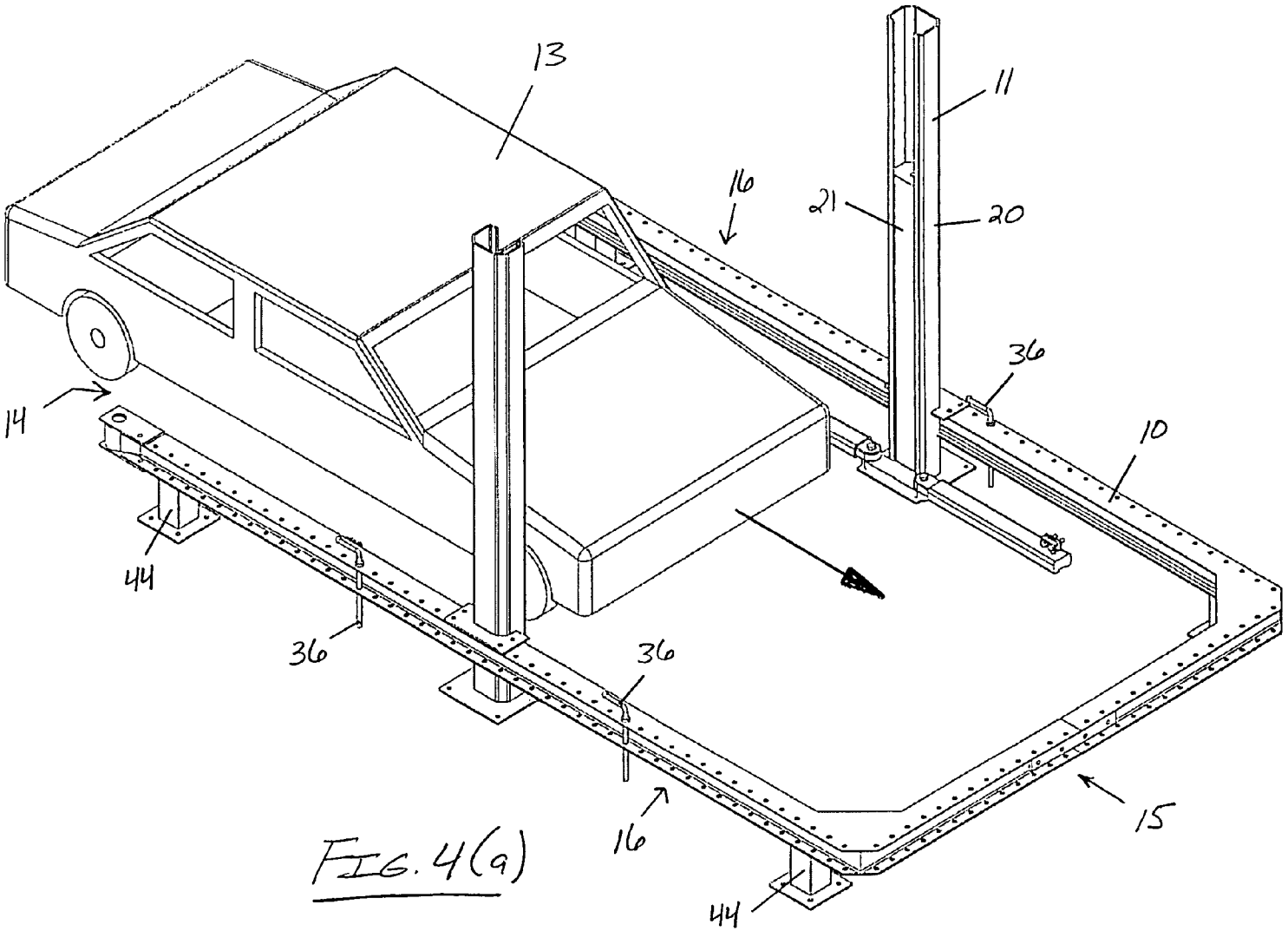
FIG. 4(*a*) is a top perspective view of the vehicular frame straightening apparatus according to the present invention receiving a vehicle, and showing a main frame and optional laterally-opposed lift tower assemblies.
Figure 4B:
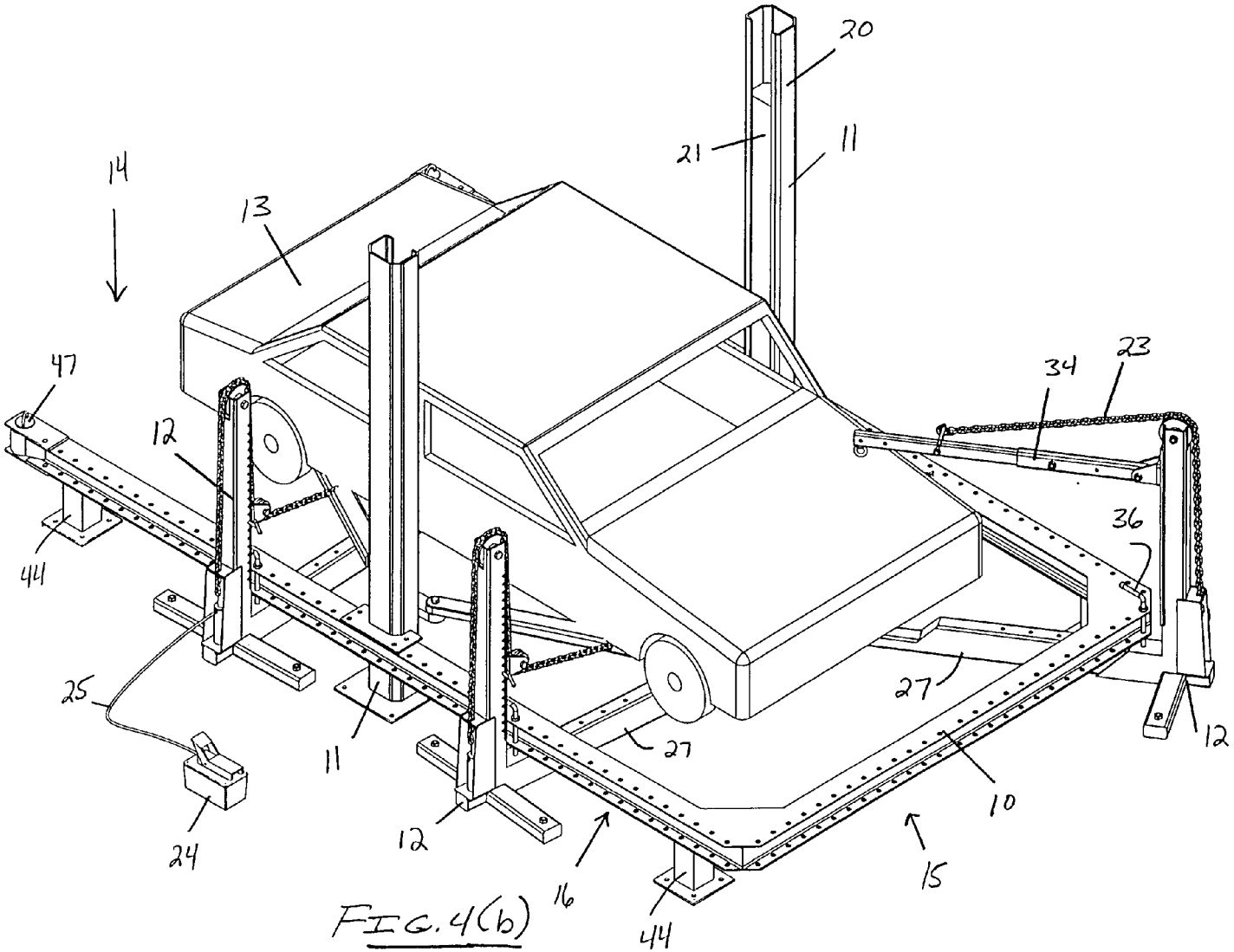
Figure 5:
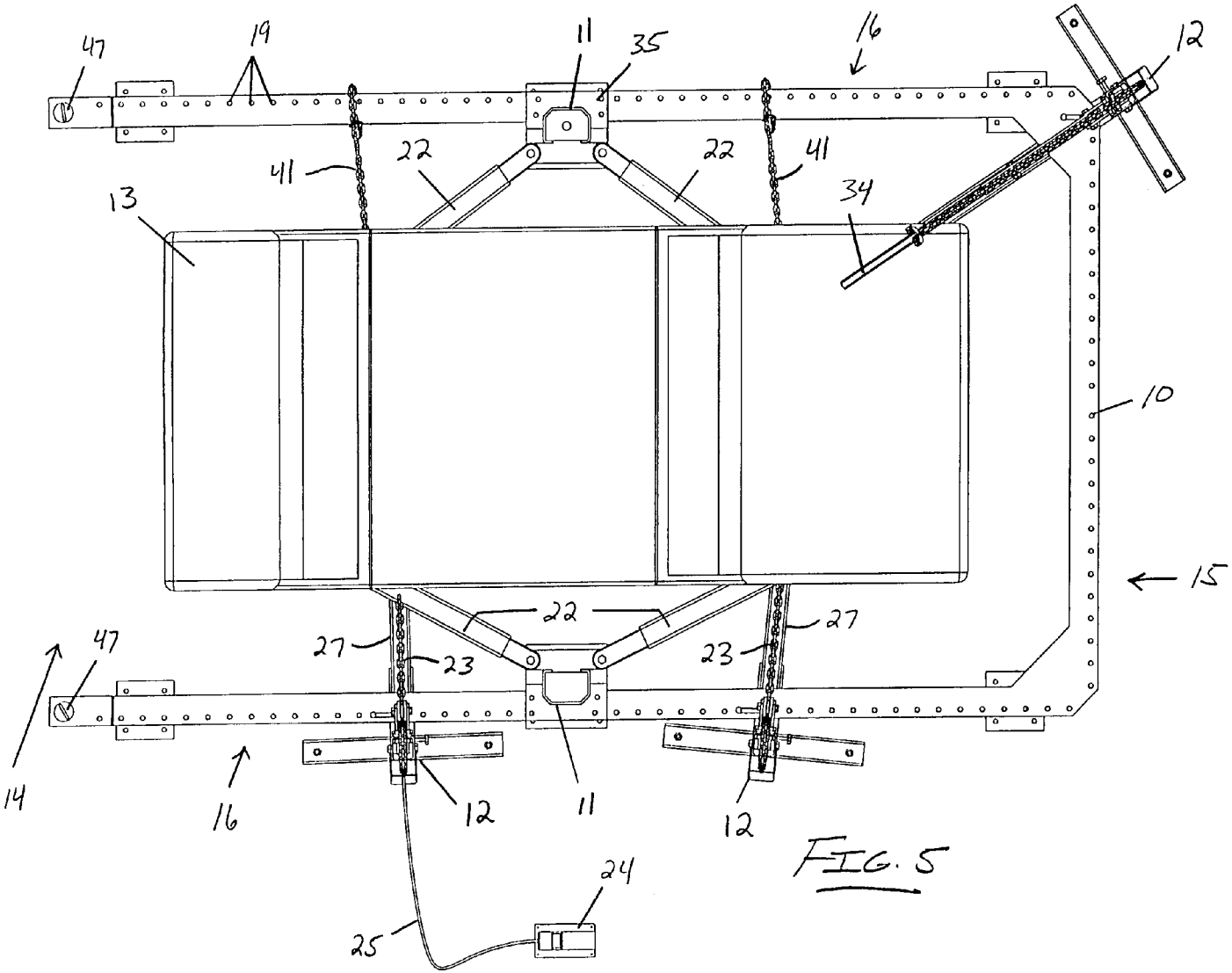
FIG. 5 is a top plan view of the vehicular frame straightening apparatus otherwise depicted in FIG. 4.
Figure 6:
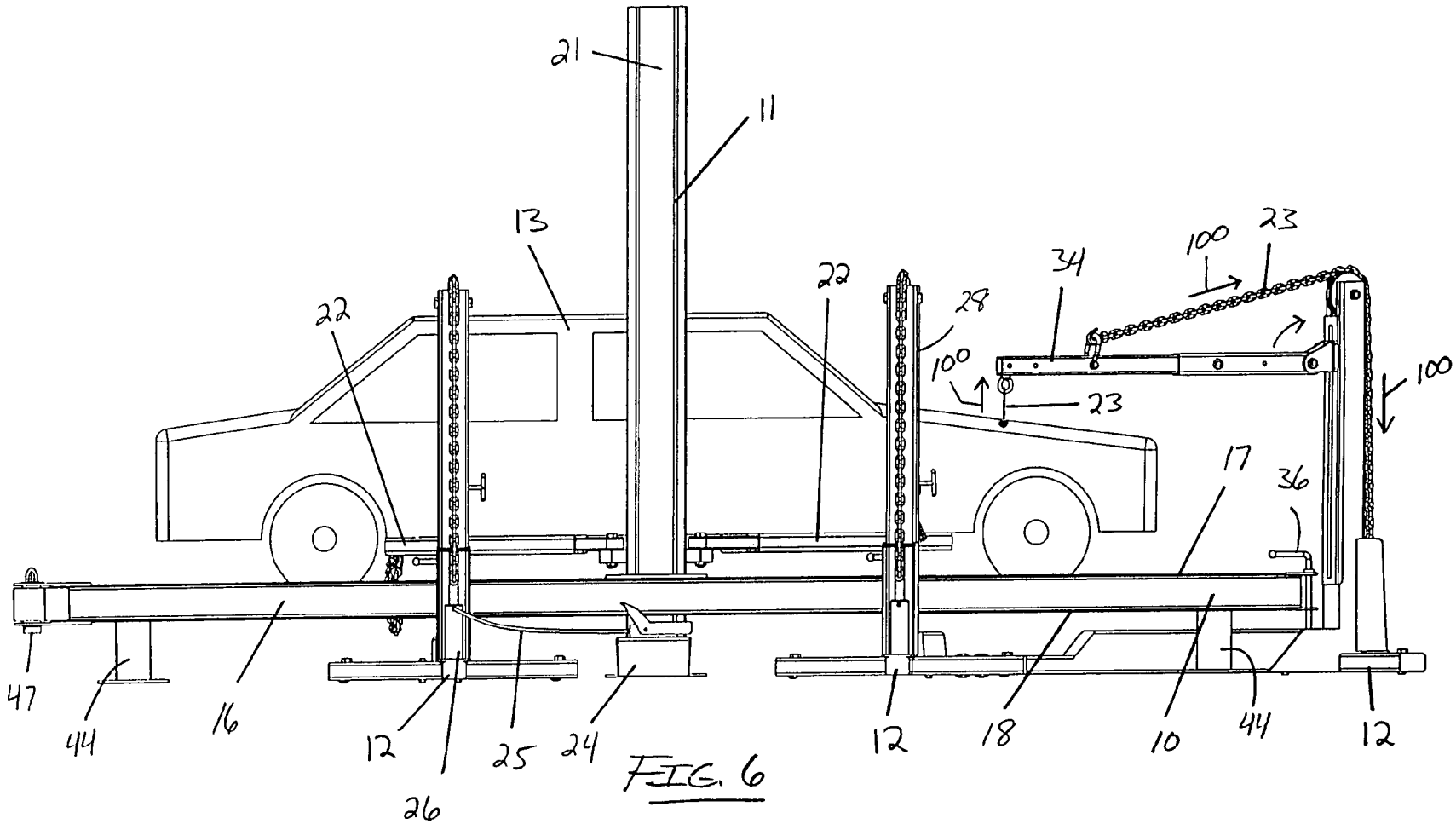
FIG. 6 is a lateral plan view of the vehicular frame straightening apparatus otherwise depicted in FIG. 4.
Figure 7:
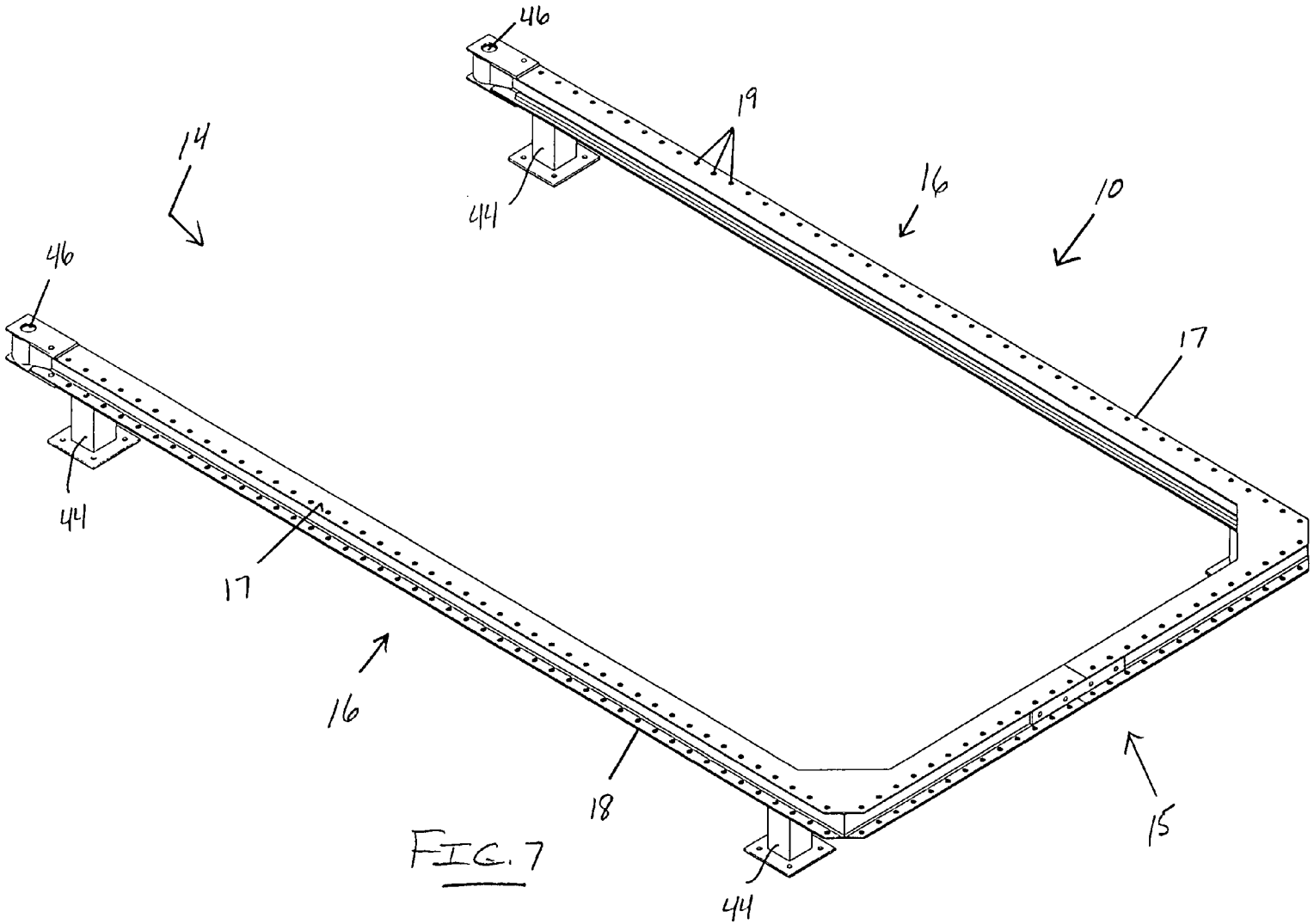
FIG. 7 is a first top perspective view of the main frame of the vehicular frame straightening apparatus.
Figure 7B:
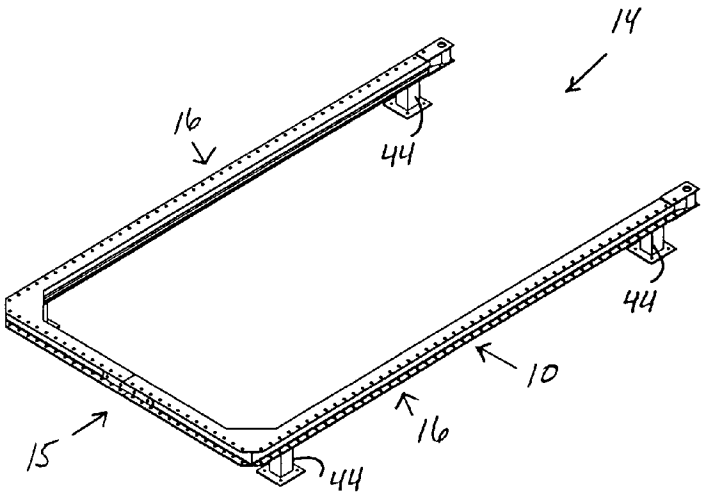
Figure 7D:
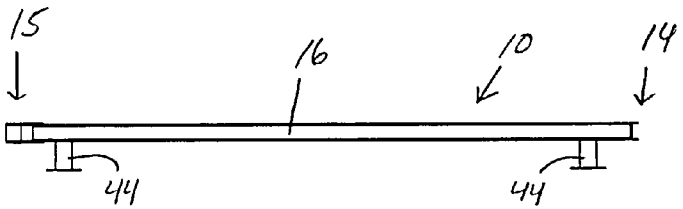
Figure 7A:
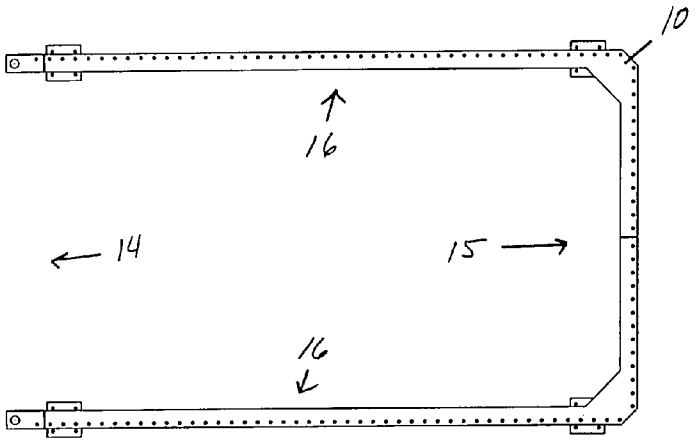
Figure 7C:
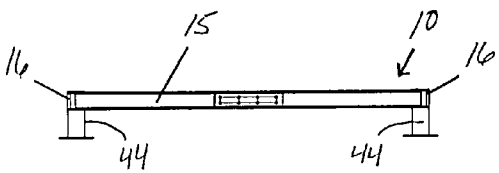
Figure 8:
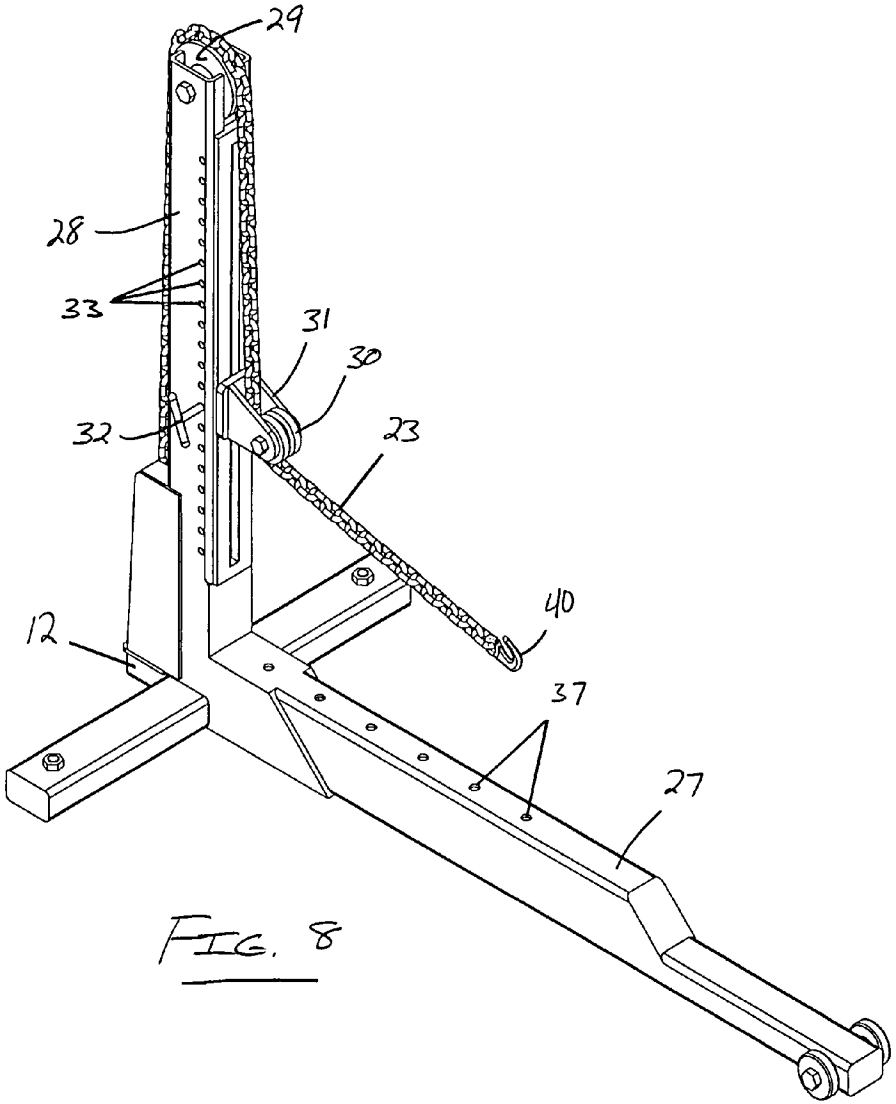
FIG. 8 is a top perspective view of a first portable pull tower assembly showing an apertured base section, an apertured upright section, a chain, a fixed upper pulley, and an adjustable lower pulley.
Figure 9:
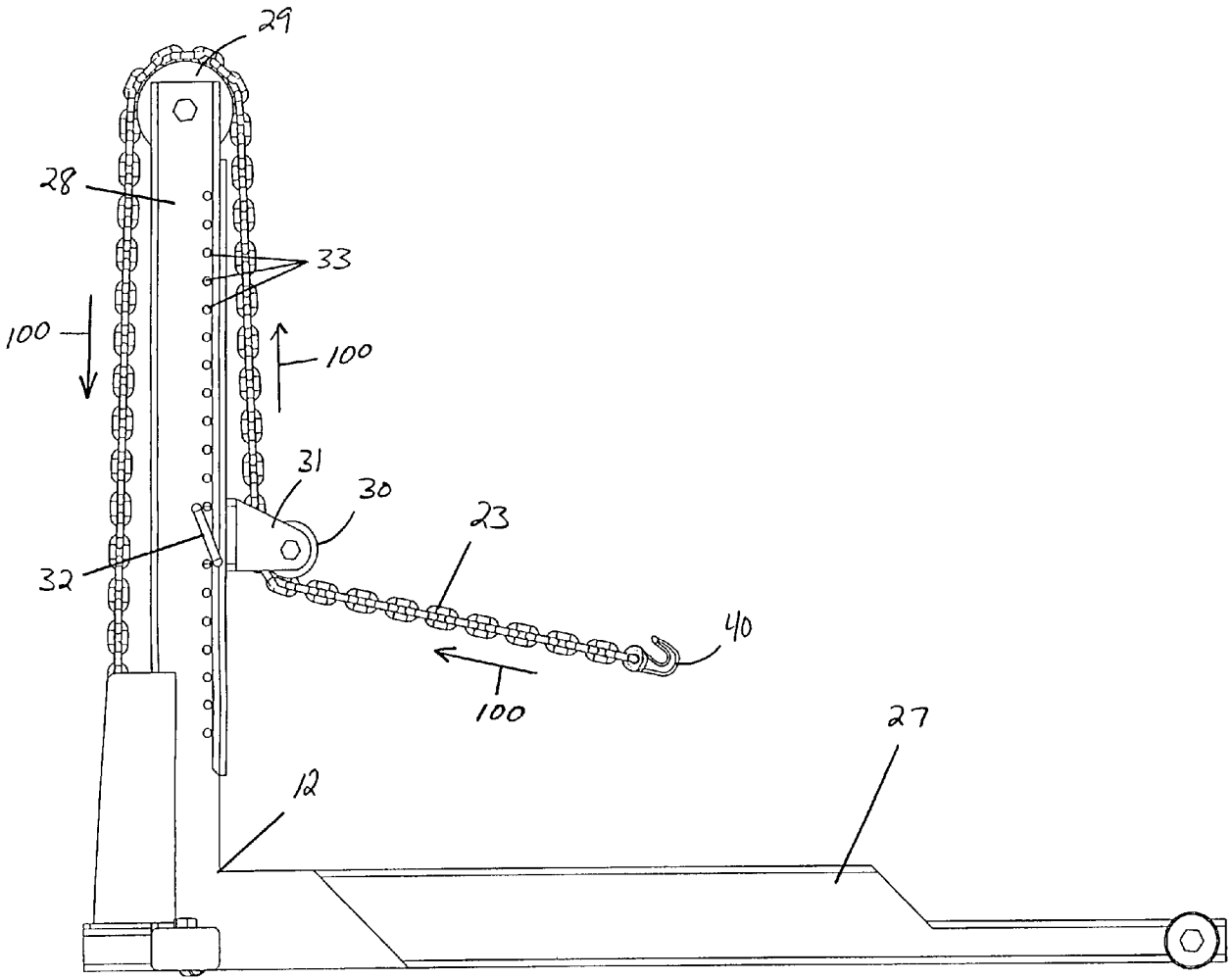
FIG. 9 is a side plan view of the portable pull tower assembly otherwise depicted in FIG. 8.
Figure 10:
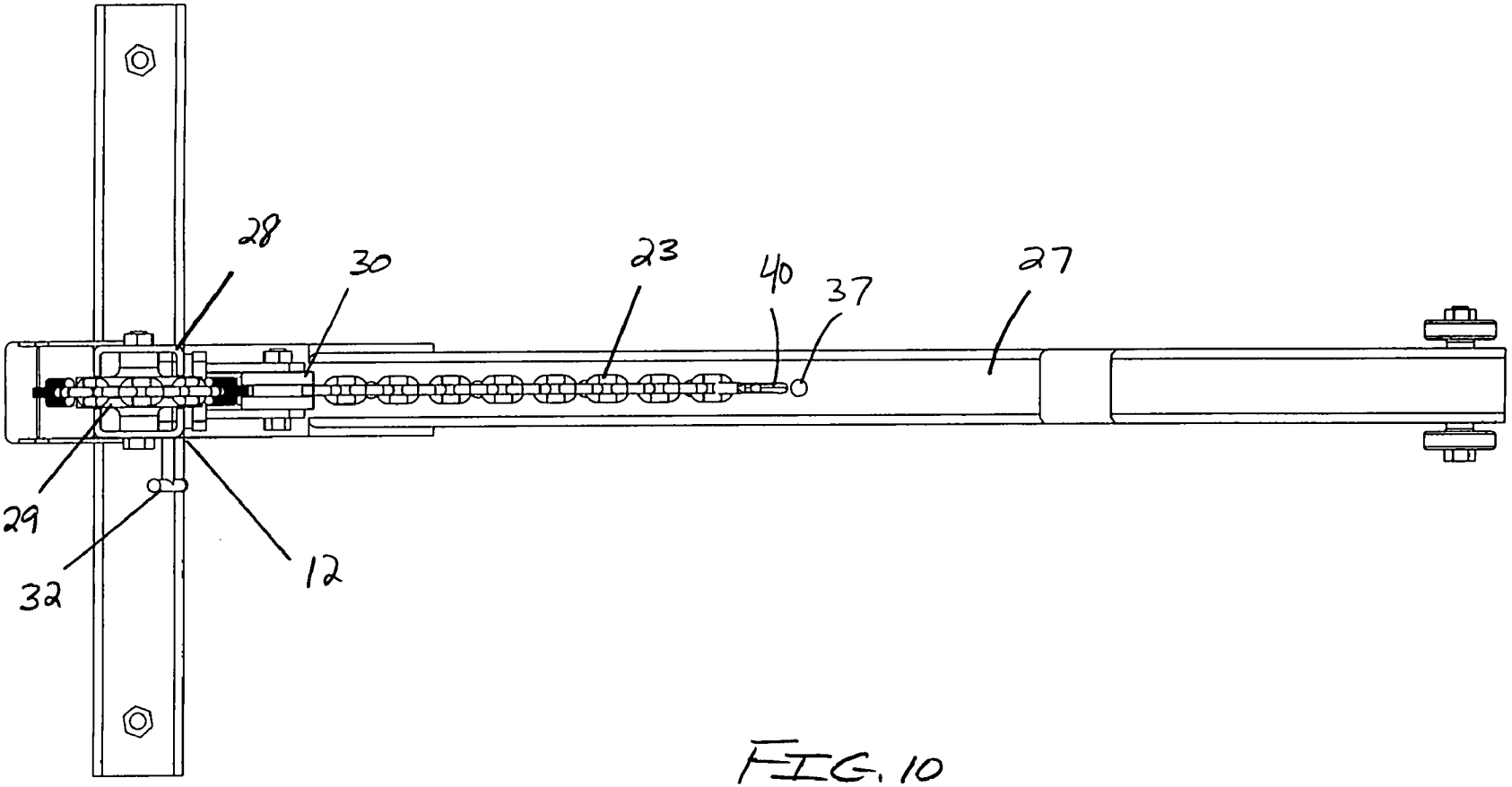
FIG. 10 is a top plan view of the portable pull tower assembly otherwise depicted in FIG. 8.
Figure 11:
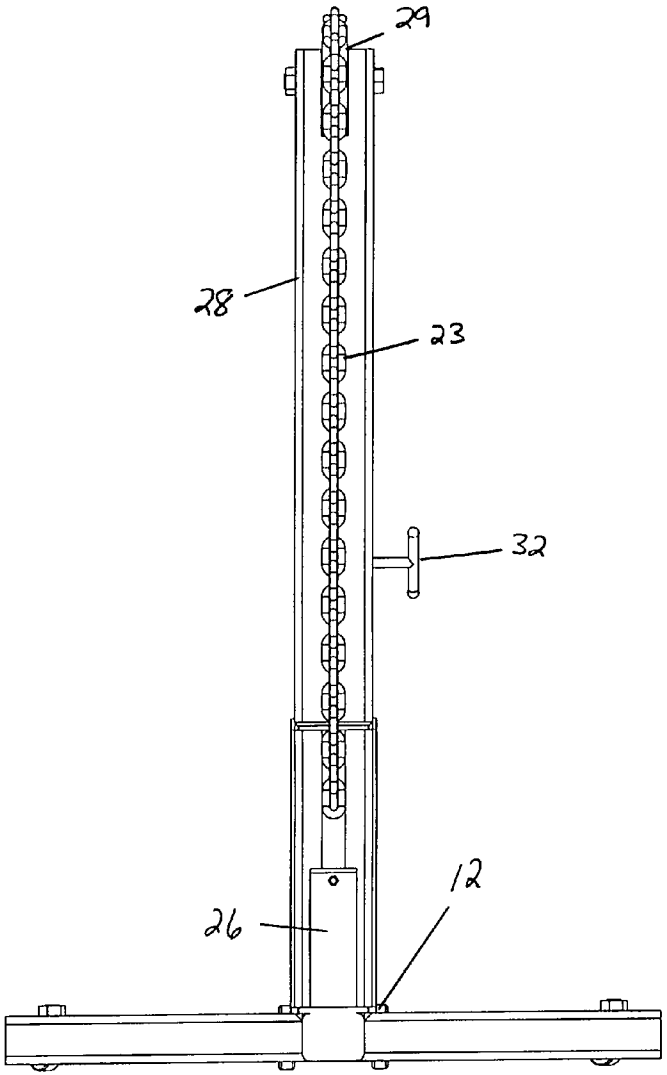
FIG. 11 is a back end view of the portable pull tower assembly otherwise depicted in FIG. 8 further showing a pull ram.

It is further contemplated that the foregoing specifications support certain vehicular structure straightening methodology. In other words, the apparatus supports a method for straightening vehicular structure comprising the steps of receiving a vehicle by a main frame length as generally depicted in FIG. 4(*a*). Notably, the main frame length has spaced structure.

The method may further comprise the steps of positioning tension applying means at select spaced structure along the main frame length; applying tension to select vehicle structure via the positioned tension applying means; and displacing the select vehicle structure relative to the fixed vehicle position (as generally depicted in FIG. 4(*b*)) via the applied tension thereby straightening vehicular structure.

Stated another way, the method for straightening vehicular structure may be said to comprise the steps of receiving a vehicle within a frame structure having spaced attachment structure; attaching tension applying means at select attachment structure of the frame structure; tensioning select vehicle structure via the selectively attached tension applying means; and displacing select vehicle structure relative to the fixed vehicle position thereby straightening vehicular structure.

Optional steps may include the step of enclosing the received vehicle within the frame structure (as for example via the rear frame member 45); the step of adjusting the tension applying means before tensioning select vehicular structure as for example via the pin 32 and apertures 33 or pin 36 and apertures 37); and the step of vertically displacing select vehicular structure while tensioning select vehicular structure.

In this last regard, it is noted that a key feature of the present invention is to provide vertically directed tension to select vehicular structure so as to otherwise straighten that structure. State of the art frame straightening devices do not typically address this function, and thus it is believed that this feature as enabled through the structures here defined (and as generally depicted in FIG. 14) is inventive to the industry.

From the foregoing, it will be observed that numerous variations and modifications of the underlying apparatus may be effected without departing from the spirit and scope of the invention. Further, certain structural straightening methodology is supported by the basic understanding of the inventive apparatus.

Thus, it is to be understood that no limitation with respect to the specific apparatus and/or methodology illustrated herein is intended or should be inferred. It is, of course, intended to cover by the appended claims all such modifications as fall within the scope of the claims.

I claim:

1. An apparatus for straightening vehicular structure, the apparatus comprising:

a U-shaped main frame, the main frame having a vehicle-receiving open end, a vehicle-stopping closed end, laterally-opposed vehicular guide portions, and a plurality of main frame support posts for elevating the main frame above a support surface substantially parallel thereto, the closed end and guide portions defining a peripheral main frame length, the main frame length defining a frame width and frame depth, the frame width and frame depth for receiving a vehicular body in a fixed vehicle position intermediate the guide portions adjacent the closed end in superior adjacency to the support surface such that the guide portions and closed end corral the vehicular body in spaced relation thereto, the main frame length comprising vertically and axially paired main frame apertures, the main frame apertures being horizontally spaced along the main frame length;

an L-shaped, repositionable tower assembly, the tower assembly comprising a horizontal base section, a vertical upright section, and tension applying means for applying tension to the vehicular body, the base section having a base section length, the base section length having vertically oriented, horizontally spaced base apertures, the base section being receivable intermediate the main frame and the support surface inferior to the main frame apertures such that the base section length extends toward the vehicular body; and an axial pin member, the pin member being receivable by a select set of apertures selected from a pair of the main frame apertures along the main frame length and a base aperture from the base section length, the pin member thus for attaching the tower assembly to the main frame at a select frame location along the main frame length, the tension applying means for applying tension to a select vehicular structure adjacent the select frame location, applied tension from the tension applying means for displacing the select vehicular structure relative to the fixed vehicle position, the apparatus thus for straightening vehicular structure.

2. The apparatus of claim 1 comprising a vehicle support cross member, the cross member comprising first and second cross member ends, the first and second cross member ends being attachable to the main frame at the guide portions, the cross member and the guide portions for supporting the vehicular body.

3. The apparatus of claim 1 comprising a rear frame member, the rear frame member comprising first and second rear frame ends, and vertically and axially paired rear frame apertures intermediate the first and second rear frame ends, the rear frame member being attachable to the main frame at the open end to close the open end, the select frame location being selected based upon the main frame apertures and the rear frame apertures.

4. The apparatus of claim 1 wherein multiple tower assemblies are cooperable with the main frame to effect select structural displacement via applied tension.

5. The apparatus of claim 3 wherein the main frame comprises an I-shaped transverse cross-section, the I-shaped transverse cross-section of the main frame having upper and lower main frame flanges, the upper and lower main frame flanges comprising the main frame apertures.

6. The apparatus of claim 1 comprising a pair of laterally-opposed lift tower assemblies, the lift tower assemblies being fastened to the guide portions of the main frame intermediate the open end and the closed end, each lift tower assembly comprising a lift member and vehicle-engaging arms pivotally attached to the lift member, the main frame and lift tower assemblies for enhancing the fixed position of the vehicular body.

7. The apparatus of claim 5 wherein the rear frame member comprises an I-shaped transverse cross-section, the I-shaped transverse cross-section of the rear frame member having upper and lower rear frame flanges, the upper and lower rear frame flanges comprising the rear frame apertures.

8. An apparatus for straightening vehicular structure, the apparatus comprising:

a U-shaped main frame, the main frame having a vehicle-receiving open end, a vehicle-stopping closed end, laterally-opposed vehicular guide portions, and main frame support means for elevating the main frame above a support surface substantially parallel thereto, the closed end and guide portions defining a peripheral main frame length, the main frame length defining a frame width and frame depth, the frame width and frame depth for receiving a vehicular body in a fixed vehicle position intermediate the guide portions adjacent the closed end in superior adjacency to the support surface such that the guide portions and closed end corral the vehicular body in spaced relation thereto, the main frame length comprising vertically oriented main frame apertures, the main frame apertures being horizontally spaced along the main frame length;

a series of L-shaped, repositionable tower assemblies, each tower assembly comprising a horizontal base section, a vertical upright section, and tension applying means for applying tension to the vehicular body as received by the U-shaped main frame, each base section having a base section length, the base section lengths each having vertically oriented, horizontally spaced base apertures, the base sections each being receivable intermediate the main frame and the support surface inferior to the main frame apertures such that the base section lengths extend toward the vehicular body; and a series of axial pin members, the pin members each being receivable by a select set of apertures selected from the main frame apertures along the main frame length and the base apertures from the base section lengths, the pin members thus for attaching the tower assemblies to the main frame at select frame locations along the main frame length, the tension applying means for applying tension to a select vehicular structure adjacent the select frame locations, applied tension from the tension applying means for displacing the select vehicular structure relative to the fixed vehicle position, the apparatus thus for straightening vehicular structure.

9. The apparatus of claim 8 comprising a vehicle support cross member, the cross member comprising first and second cross member ends, the first and second cross member ends being attachable to the main frame at the guide portions, the cross member and the guide portions for supporting the vehicular body as received by the main frame.

10. The apparatus of claim 8 comprising a rear frame member, the rear frame member comprising first and second rear frame ends and vertically oriented rear frame apertures intermediate the first and second rear frame ends, the rear frame member being attachable to the main frame at the open end to close the open end, the select frame locations being selected based upon the main frame apertures and the rear frame apertures.

11. The apparatus of claim 8 wherein the main frame comprises axially paired main frame apertures.

12. The apparatus of claim 8 comprising a pair of laterally-opposed lift tower assemblies, the lift tower assemblies being fastened to the main frame intermediate the open end and closed end, each lift tower assembly comprising a lift member and vehicle-engaging arms pivotally attached to the lift member, the main frame and lift tower assemblies for fixing the position of the vehicular body as received by the main frame.

13. The apparatus of claim 10 wherein the rear frame member comprises axially paired rear frame apertures.

14. An apparatus for straightening vehicular structure, the apparatus comprising:

a U-shaped main frame, the main frame having a vehicle-receiving open end, a vehicle-stopping closed end, laterally-opposed vehicular guide portions, and main frame support means for elevating the main frame above a support surface substantially parallel thereto, the closed end and guide portions defining a peripheral main frame length, the main frame length defining a frame width and frame depth, the frame width and frame depth for receiving a vehicular body in a fixed vehicle position intermediate the guide portions adjacent the closed end in superior adjacency to the support surface such that the guide portions and closed end corral the vehicular body in spaced relation thereto, the main frame length comprising horizontally spaced, main frame structure for removably attaching repositionable tension applying means; and a portable pull tower assembly removably attachable to the horizontally spaced main frame structure, the pull tower assembly comprising a horizontal base section, a vertical upright section, tension applying means for applying tension to the vehicular body, and attachment means for attaching the pull tower assembly to the horizontally spaced, main frame structure, the base section having a base section length, the base section length having horizontally spaced, base structure, the base section being receivable intermediate the main frame and the support surface inferior to the horizontally spaced, main frame structure such that the base section length extends toward the vehicular body, the main frame for fixing the position of the vehicular body as received via the open end intermediate the vehicular guide portions, the tension applying means for applying tension to a select vehicular structure, said means thus for displacing the select vehicular structure relative to the fixed vehicle position via applied tension, the apparatus thus for straightening vehicular structure.

15. The apparatus of claim 14 comprising a vehicle support cross member, the cross member comprising first and second cross member ends, the first and second cross member ends being attachable to the main frame at the guide portions, the cross member and the guide portions for supporting the vehicular body as received by the main frame.

16. The apparatus of claim 14 comprising a rear frame member, the rear frame member comprising first and second rear frame ends and horizontally spaced, rear frame structure intermediate the first and second rear frame ends, the rear frame member being attachable to the main frame at the open end to close the open end.

17. The apparatus of claim 14 wherein the main frame comprises an I-shaped transverse cross-section, the I-shaped transverse cross-section of the main frame having upper and lower main frame flanges, the upper and lower main frame flanges comprising vertically and axially paired main frame apertures and the base section of the tower assembly comprising vertically oriented, horizontally spaced base apertures, said attachment means being cooperable with the main frame apertures and the base apertures for adjusting the tower assembly relative to the main frame.

18. The apparatus of claim 14 wherein a series of portable pull tower assemblies are cooperable with the main frame to effect select structural displacement of the vehicular body as received by the main frame via applied tension.

19. The apparatus of claim 14 comprising a pair of laterally-opposed lift tower assemblies, the lift tower assemblies being fastened to the main frame intermediate the open end and closed end, each lift tower assembly comprising a lift member and vehicle-engaging arms pivotally attached to the lift member, the main frame and lift tower assemblies for fixing the position of the vehicular body as received by the main frame.

20. The apparatus of claim 17 comprising a rear frame member, the rear frame member comprising an I-shaped transverse cross section, and first and second rear frame ends, the I-shaped transverse cross-section of the rear frame member having upper and lower rear frame flanges, the upper and lower rear frame flanges comprising vertically and axially paired rear frame apertures intermediate the first and second rear frame ends, the rear frame member being attachable to the main frame at the open end to close the open end, said attachment means being cooperable with the rear frame apertures and base apertures for adjusting the tower assembly relative to the main frame.

* * * * *